US010118809B2

(12) United States Patent
Tygard

(10) Patent No.: US 10,118,809 B2
(45) Date of Patent: Nov. 6, 2018

(54) LOAD MANIPULATOR

(71) Applicant: Edward Tygard, McMurray, PA (US)

(72) Inventor: Edward Tygard, McMurray, PA (US)

(73) Assignee: Tygard Machine & Manufacturing Company, Washington, PA (US)

( * ) Notice: Subject to any disclaimer, the term of this patent is extended or adjusted under 35 U.S.C. 154(b) by 0 days.

(21) Appl. No.: 15/634,897

(22) Filed: Jun. 27, 2017

(65) Prior Publication Data

US 2017/0369295 A1 Dec. 28, 2017

Related U.S. Application Data

(60) Provisional application No. 62/355,201, filed on Jun. 27, 2016.

(51) Int. Cl.

| | |
|---|---|
| ***B66F 9/18*** | (2006.01) |
| ***B66C 1/44*** | (2006.01) |
| ***B66F 9/14*** | (2006.01) |

(52) U.S. Cl.

CPC ..... *B66F 9/183* (2013.01); *B66C 1/44* (2013.01); *B66F 9/144* (2013.01)

(58) Field of Classification Search

CPC .. B66F 9/14; B66F 9/141; B66F 9/147; B66F 9/148; B66F 9/188; B66F 9/10; B65G 60/00

See application file for complete search history.

(56) References Cited

U.S. PATENT DOCUMENTS

| | | | | |
|---|---|---|---|---|
| 3,166,209 A | | 1/1965 | Haddock | 214/730 |
| 3,313,436 A | | 4/1967 | Mathew et al. | 214/672 |
| 3,472,408 A | | 10/1969 | Hendricks et al. | 214/674 |
| 3,715,046 A | * | 2/1973 | Marklund | B60P 1/4421 414/631 |
| 3,820,674 A | | 6/1974 | Goodacre et al. | 214/730 |
| 3,822,803 A | | 7/1974 | Thompson | 214/620 |
| 3,907,140 A | | 9/1975 | Jinks | 214/671 |
| 3,977,550 A | | 8/1976 | Crawford et al. | 214/730 |
| 4,033,471 A | | 7/1977 | Warner | 214/671 |
| 4,236,862 A | | 12/1980 | McCormick | 414/633 |
| 4,439,102 A | | 3/1984 | Allen | 414/633 |

(Continued)

FOREIGN PATENT DOCUMENTS

WO WO2011/073009 * 6/2011 ..... B66F 9/14

OTHER PUBLICATIONS

Machine translation of WO2011/073009 from espacenet, available at http://translationportal.epo.org/emtp/translate/?ACTION=description-retrieval&COUNTRY=WO&ENGINE=google&FORMAT=docdb&KIND=A1&LOCALE=en_EP&NUMBER=2011073009&OPS=ops.epo.org/3.2&SRCLANG=de&TRGLANG=en, accessed Mar. 22, 2018. (Year: 2011).*

*Primary Examiner* — Mark C Hageman
(74) *Attorney, Agent, or Firm* — Michael Tobias

(57) ABSTRACT

A manipulator for transporting a load laterally with respect to a vehicle includes a support frame adapted for mounting on a vehicle. A movable guide is supported by the support frame for lateral translation with respect to the support frame. A carriage which is capable of supporting a load engaging attachment for supporting a load is supported by the guide for translation with respect to the guide in the lengthwise direction of the guide. The carriage can translate with respect to the guide in the lengthwise direction of the guide at the same time that the guide is translating laterally with respect to the support frame.

25 Claims, 15 Drawing Sheets

(56) References Cited

U.S. PATENT DOCUMENTS

| | | | | |
|---|---|---|---|---|
| 4,690,609 | A | 9/1987 | Brown | 414/543 |
| 5,036,952 | A | 8/1991 | Harper | 187/9 E |
| 7,011,487 | B2 * | 3/2006 | Kafka | B66F 9/07 414/459 |
| 7,648,325 | B2 | 1/2010 | Schottke | 414/666 |
| 7,841,822 | B2 * | 11/2010 | Tygard | B66F 9/188 414/623 |
| 8,087,868 | B2 | 1/2012 | Turnbull et al. | 414/668 |

* cited by examiner

LOAD MANIPULATOR

REFERENCE TO RELATED APPLICATION

This application claims the benefit of U.S. Provisional Application No. 62/355,201 filed on Jun. 27, 2016, the disclosure of which is incorporated by reference.

BACKGROUND OF THE INVENTION

This invention relates to a manipulator which is suitable for mounting on a vehicle and which is capable of moving a load laterally with respect to the vehicle. In particular but not exclusively, it relates to a manipulator which is capable of moving a load between opposite widthwise sides of the vehicle.

Self-propelled vehicles referred to as forklifts are commonly used in a wide variety of industrial and commercial facilities to transport loads within the facilities. A forklift is a powered industrial truck which typically includes a self-powered, wheeled, steerable body and an upright structure referred to as a mast which is mounted on the body and along which a load can be raised and lowered. Many forklifts are capable of engaging only a load disposed directly in front of the forklift, but there are also forklifts which are able to engage a load disposed on a widthwise side of the forklift and then move the load laterally to the opposite widthwise side of the forklift. In the course of moving a load between opposite widthwise sides of the forklift, it is generally necessary to swing or rotate the load about a vertical axis. This swinging or rotational movement can apply significant loads to the forklift, resulting in equipment wear and vibrations. In addition, the need to swing or rotate the load places limitations on spaces in which the forklift can operate.

SUMMARY OF THE INVENTION

The present invention provides a manipulator which is suitable for mounting on a vehicle and which can smoothly transport a load laterally with respect to the vehicle.

The present invention also provides a manipulator which can transport a load between opposite widthwise sides of a vehicle without having to rotate the load.

The present invention also provides a lifting arrangement comprising a manipulator mounted on a vehicle and a load engaging attachment which is supported by the manipulator and is adapted to engage and support a load.

The present invention additionally provides a method of moving a load laterally with respect to a vehicle.

According to one form of the present invention, a manipulator includes a support frame adapted for mounting on a vehicle, a movable guide supported by the support frame for lateral translation with respect to the support frame, and a carriage for supporting a load engaging attachment for engaging and supporting a load. The carriage is supported by the guide so as to translate with respect to the guide and to undergo lateral translation with respect to the support frame as the guide is laterally translating with respect to the support frame.

According to another form of the present invention, a lifting arrangement comprises a vehicle equipped with a lifting mechanism and a manipulator according to the present invention supported by the lifting mechanism.

A manipulator according to the present invention is not limited to use with any particular type of vehicle, but it is particularly suitable for use with a powered industrial truck, which is defined by the American Society of Mechanical Engineers as a mobile, power-propelled truck used to carry, push, pull, lift, stack or tier materials. Powered industrial trucks which have the ability to raise and lower a load will be generically referred to in this specification as forklifts. Some nonlimiting examples of different types of forklifts with which a manipulator according to the present invention can be employed are rider trucks (both stand up and sit down types), pedestrian-controlled trucks, rough terrain forklift trucks, narrow aisle trucks, straddle trucks, order pickers, reach-type trucks, pallet trucks, and turret trucks Lateral translation or movement of the guide or the carriage here refers to movement which changes the distance of the guide or the carriage from a widthwise center of the support frame or from a widthwise center of a vehicle when the manipulator is mounted on a vehicle. The lateral translation may be translation which is normal to a centerline plane of the vehicle with no vertical component or component in a lengthwise direction of the vehicle, or the lateral translation may include one or both of a vertical component and a component in a lengthwise direction of the vehicle in addition to a component normal to a centerline plane of the vehicle. Therefore, when the guide and the carriage are moving laterally with respect to the vehicle, it is possible for one or both of their height and their position in a longitudinal direction of the vehicle to vary.

The load engaging attachment may be any type of device capable of engaging and supporting a load. Typical load engaging attachments are so-called forklift attachments adapted for mounting on industrial forklifts, such as forks, layer pickers, barrel clamps, bale clamps, carton clamps, and paper roll clamps. In preferred embodiments, the loading engaging attachment comprises a layer picker.

The vehicle may be stationary or moving as a load is being moved laterally with respect to the vehicle by the manipulator. The lifting mechanism of the vehicle may maintain the load at a substantially constant height as the load is being moved laterally or it may be operated to raise or lower a load as the load is being moved laterally with respect to the vehicle by the manipulator.

The carriage of the manipulator has a range of lateral movement which may be symmetric with respect to a widthwise centerline of a vehicle on which the manipulator is mounted. Namely, the range of lateral movement of the carriage may be such that the carriage can move laterally with respect to the vehicle by equal distances to either side of the widthwise centerline of the vehicle. Alternatively, the range of lateral movement of the carriage may be asymmetric, with the carriage being capable of lateral movement by a greater distance to one side of the widthwise centerline of a vehicle on which the manipulator is mounted than to the opposite side.

In preferred embodiments, the carriage is capable of moving laterally beyond each widthwise side of a vehicle on which the manipulator is mounted to enable the carriage to access a load disposed beyond either widthwise side of the vehicle. Alternatively, the range of movement of the carriage can be such that the carriage can move laterally beyond only one widthwise side of a vehicle or such that the carriage always remains between the two widthwise sides of a vehicle on which the manipulator is mounted.

DESCRIPTION OF PREFERRED EMBODIMENTS

Figure 1:
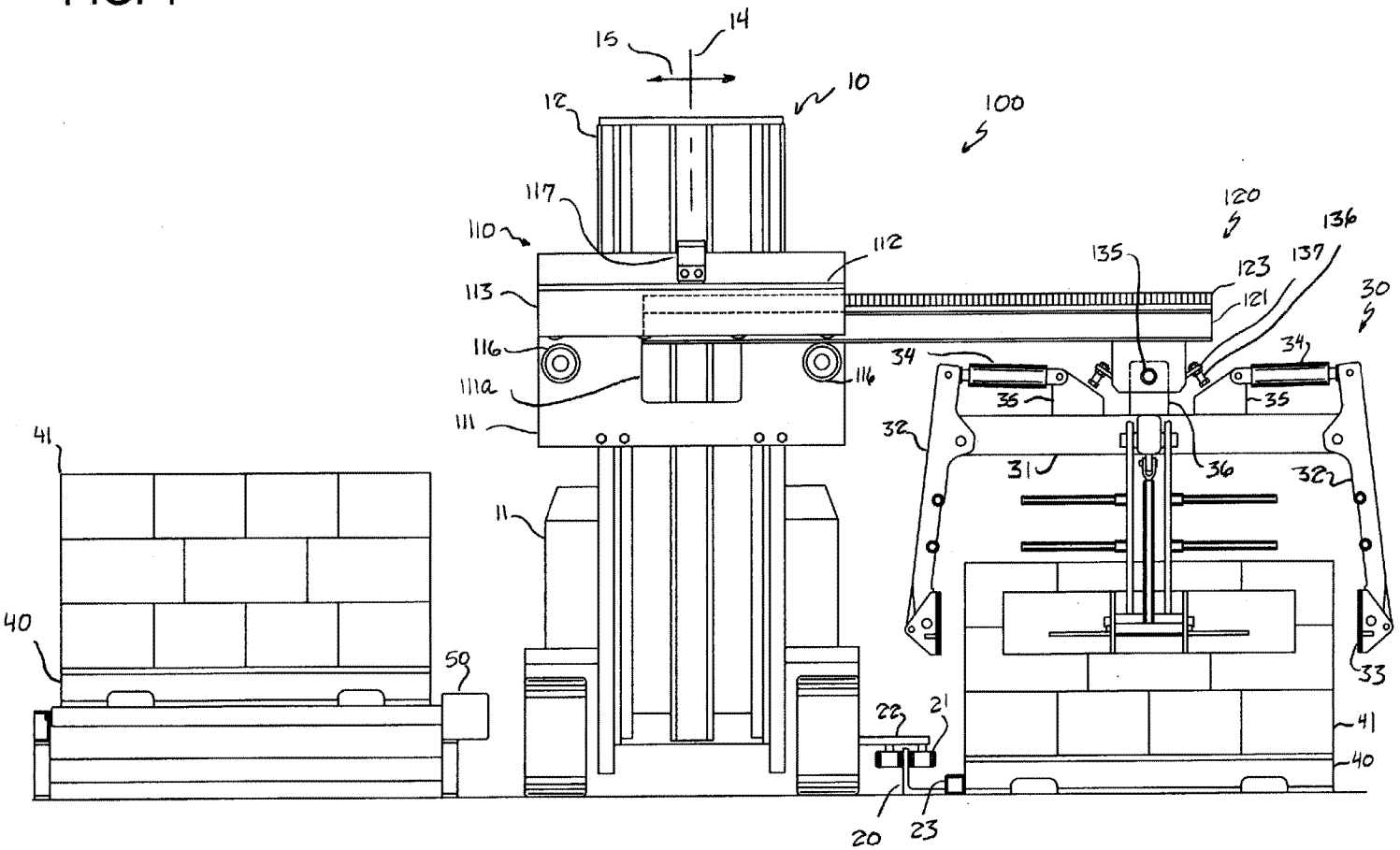
FIG. 1 is a front elevation of an embodiment of a manipulator according to the present invention mounted on a forklift.
Figure 2:
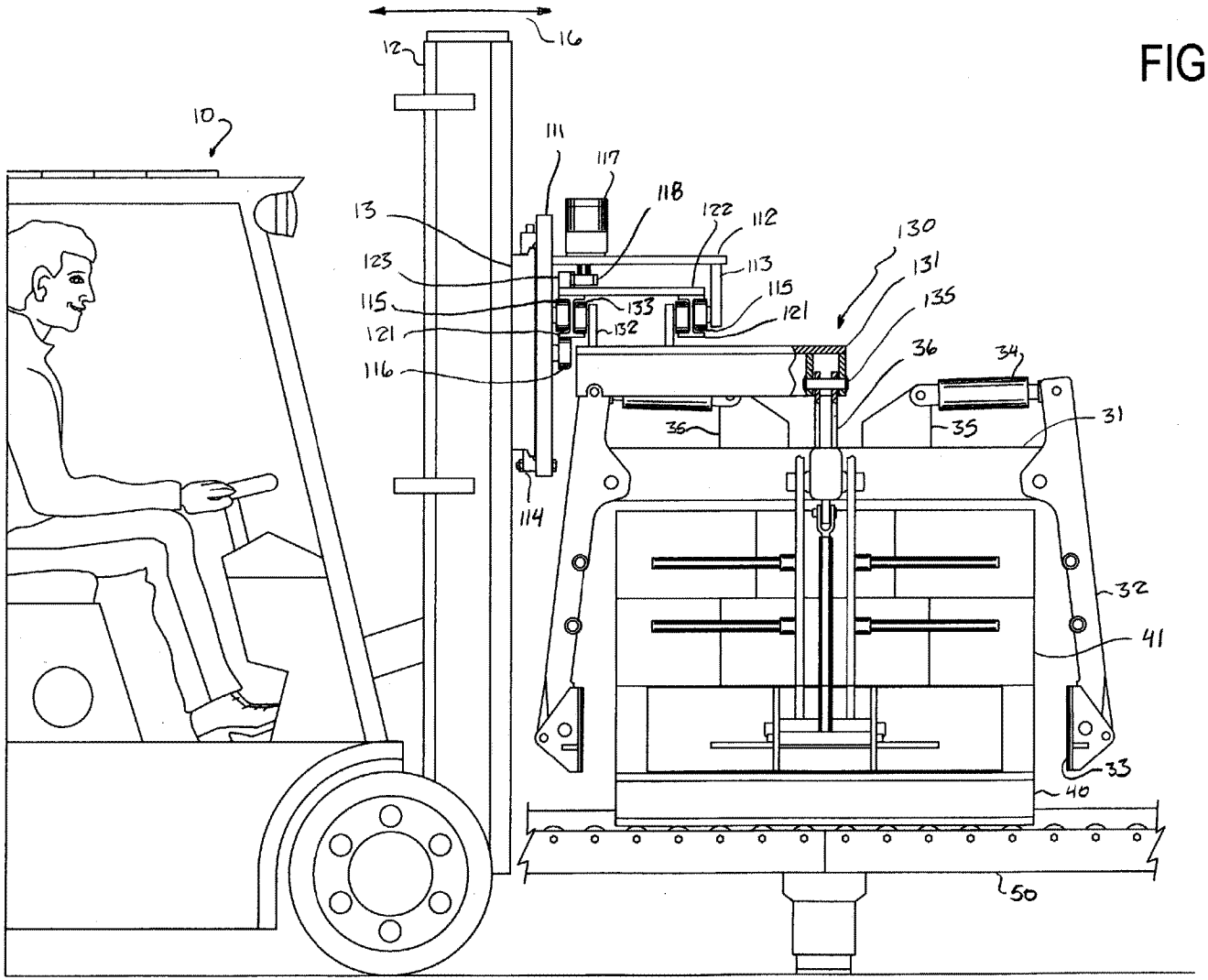
FIG. 2 is a side elevation of the embodiment shown in FIG. 1.

A number of embodiments of a manipulator according to the present invention will be described while referring to the accompanying drawings. FIGS. 1 and 2 are respectively a front elevation and a side elevation of an embodiment of a manipulator 100 according to the present invention mounted on the front of a forklift 10. The manipulator 100 includes a support frame 110, a movable guide 120 which can translate with respect to the support frame 110 so as to move laterally with respect to the forklift 10, and a carriage 130 which can translate with respect to the guide 120 in a lengthwise direction of the guide 120 while supporting a load engaging attachment. In the present embodiment, the load engaging attachment is a layer picker, which refers to a device which is capable of grasping and lifting one or more layers of objects in a stack comprising multiple layers. The load engaging attachment will be referred to as a clamping apparatus 30.

The forklift 10 may be of conventional structure. It includes a self-propelled wheeled body 11 on which an operator can stand or sit while operating the forklift 10 and a mast 12 mounted on the front of the body 11. However, other types of forklifts can be employed. For example, the forklift may be of the type which can be operated by an operator standing on the ground near the forklift, or it may of the type in which the operator stands or sits inside a cab which is raised and lowered along the mast together with a load. The illustrated mast 12 is what is referred to as a two-stage mast which includes a stationary pair of vertical outer channels and a movable pair of vertical inner channels which can be raised and lowered with respect to the outer channels. However, the mast 12 may instead be a single-stage mast or a mast having three or more stages. A mast carriage 13 for supporting forks or other type of load engaging attachment is mounted on the front of the mast 12 in a conventional manner so as to be raised and lowered along the mast 12. The mast 12 may include structure for resisting moments acting on the mast 12 or the carriage 13 about a horizontal axis as described, for example, in U.S. Pat. No. 7,993,094 entitled "Lift Truck", the disclosure of which is incorporated by reference. Structure for raising and lowering the inner channels of the mast 12 with respect to the outer channels and structure for raising and lowering the mast carriage 13 with respect to the mast 12 may be conventional and so has been omitted from the drawings. Such structure frequently includes a hydraulic cylinder and a chain and pulley mechanism. As is conventional, the forklift 10 may also include an unillustrated mechanism for tilting the mast with respect to the vertical forward or backwards about a horizontal axis. In FIG. 2, the mast 12 is shown extending perpendicular to the surface on which the forklift 10 is operating.

The line identified by reference number 14 in FIG. 1, which is perpendicular to the surface on which the forklift 10 is disposed, is the widthwise centerline of the forklift 10 which is located at the widthwise center of the forklift 10, which is a location halfway between the left and right sides of the forklift 10. The widthwise centerline 14 lies in a centerline plane of the forklift 10, which is an imaginary plane which extends perpendicular to the surface on which the forklift 10 is disposed and also extends along the length of the forklift 10 through the widthwise center of the forklift 10. The double-headed arrow 15 in FIG. 1 indicates the widthwise directions of the forklift 10 (to the left and right in the figure), which are perpendicular to the centerline plane. The double-headed arrow 16 in FIG. 2 indicates the lengthwise directions of the forklift 10 (towards the front and rear of the forklift 10). When the guide 120 and the carriage 130 undergo lateral movement with respect to the forklift 10, the direction of movement includes at least a component which is parallel to the widthwise directions of the forklift 10 shown by arrow 15 but may also include one or both of a vertical component and a component parallel to the lengthwise directions of the forklift 10.

In order to make it easier for the operator of the forklift 10 to accurately position the forklift 10 with respect to a load, the forklift 10 may be equipped with a guide system which guides the forklift 10 along a path without the operator having to steer the forklift 10. An example of a suitable guide system is described in U.S. Pat. No. 6,477,964 entitled "Guide System for a Forklift", the disclosure of which is incorporated by reference. The present embodiment includes a guide system comprising a guide rail 20 in the form of an angle iron secured to the floor of a warehouse or other facility where the forklift 10 is to be operated and two pairs of rollers 21 (only one of the pairs of rollers 21 is shown in FIG. 1) rotatably mounted on a bracket 22 secured to a side of the forklift 10. The two pairs of rollers 21 are provided in two locations spaced from each other in a lengthwise direction of the forklift 10. The guide rail 20 has a vertical leg which extends vertically between the two rollers 21 of each pair of rollers so that the rollers 21 can roll along the sides of the vertical leg. The engagement between the rollers 21 and the guide rail 20 keeps the forklift 10 traveling in a direction parallel to a lengthwise direction of the guide rail 20. A positioning tube 23 having a rectangular or other cross section is secured to the horizontal leg of the guide rail 20. One or more pallets 40 containing loads 41 to be accessed by the clamping apparatus 30 can be placed on the floor of a warehouse or other facility with an edge of each pallet 40 contacting or in close proximity to the positioning tube 23 so that each pallet 40 is at a nearly constant distance from the widthwise center of the forklift 10.

The support frame 110 of the manipulator 100 is not restricted to any particular shape. As shown in FIG. 2, in the present embodiment, it is generally L-shaped as viewed from the side and includes a first vertical portion 111 such as a rigid plate of steel or other strong material which is detachably mounted on the mast carriage 13 of the forklift 10, a horizontal portion 112 such as another rigid plate which extends forward from the front side of the first vertical portion 111, and a second vertical portion 113 such as another rigid plate which extends vertically downwards from the front end of the horizontal portion 112. Conventional mounting clips 114 for detachably mounting the support frame 110 on the mast carriage 13 of the forklift 10 may be secured to the rear side of the first vertical portion 111. An opening 111*a* to provide visibility for the operator of the forklift 10 may be formed in the first vertical portion 111. The support frame 110 is shown mounted on the forklift 10 with the widthwise center of the support frame 110 coinciding with the widthwise centerline 14 of the forklift 10, but the support frame 110 need not be centered with respect to the forklift 10.

It is possible for the support frame 110 to be integrated with the mast carriage 13 so as to form a single member, although it is convenient if the support frame 110 is detachably mounted on the mast carriage 13 so that the manipulator 100 can be removed from the forklift 10 when not needed to enable the forklift 10 to be used with various types of load engaging attachments, such as forks. In the present embodiment, the support frame 110 is directly mounted on the mast carriage 13, but it is also possible for the support frame 110 to be supported by the mast carriage 13 through an intermediate member, such as a conventional pantograph mechanism for forklifts which can adjust the distance of the support frame 110 from the mast carriage 13 or a conventional side shifter. Thus, the manipulator 100 can be supported by the mast 12 of the forklift 10 in any manner that makes it possible to raise and lower the manipulator 100.

The movable guide 120 can have any structure which enables it to translate laterally with respect to the support frame 110 and which also enables the guide 120 to support the carriage 130 for translation with respect to the guide 120 in a lengthwise direction of the guide 120. For example, the guide 120 may comprise beams, channels, angle irons, plates, bars, or other structural members. In the present embodiment, the guide 120 includes a pair of rigid I-shaped beams 121 which extend parallel to each other in the widthwise direction of the forklift 10. The beams 121 are illustrated as extending horizontally, but it is also possible for the beams 121 to be sloped with respect to the horizontal. The illustrated beams 121 are straight over their entire length and have a constant transverse cross section over their length. The beams 121 are rigidly secured to each other at a plurality of locations along their length by connecting plates 122. As shown in FIG. 2, the beams 121 are supported for translation with respect to the support frame 110 in the lengthwise direction of the beams 121 by a plurality of rollers 115 which have horizontal rotational axes and which are rotatably mounted on the first and second vertical portions 111 and 113 of the support frame 110. Each of the rollers 115 is disposed between the upper and lower flanges of one of the beams 121 so that the beams 121 can translate in their lengthwise direction while resting on the rollers 115. As shown in FIG. 1, additional rollers 116 for supporting the rear of the two beams 121 from below may be mounted on the front side of the first vertical portion 111 of the support frame 110. Instead of being supported by rollers, the guide 120 may be supported by the support frame 110 for sliding movement in the lengthwise direction of the guide 120 by sliding bearings, for example.

The guide 120 can be made to translate laterally with respect to the support frame 110 by any suitable mechanism, such as a hydraulic or pneumatic piston, a cable or belt and pulley arrangement, a chain and sprocket arrangement, or a linear motor, to give a few examples. The present embodiment uses a rack and pinion arrangement for this purpose. An elongated rack 123 which extends parallel to the lengthwise direction of the guide 120 is secured atop the rear of the two beams 121 of the guide 120 with the teeth of the rack 123 facing forwards, i.e., away from the forklift 10. A motor 117 having a rotating output shaft is secured to the horizontal portion 112 of the support frame 110, and a pinion 118 is secured to and rotates with the output shaft of the motor 117 with the teeth of the pinion 118 engaging the teeth of the rack 123. When the motor 117 is operated to rotate the pinion 118, the engagement between the rack 123 and the pinion 118 causes the guide 120 to translate in its lengthwise direction to either the left or the right in FIG. 1. The present embodiment uses a hydraulic motor as the motor 117, but it is also possible to use a different type of motor, such as an electric motor. A hydraulic motor can be powered by the hydraulic system of the forklift 10 (which is typically used to raise and lower the mast and the mast carriage) through unillustrated hydraulic lines. The motor 117 can be controlled by the operator of the forklift 10 by a suitable controller provided on the forklift 10, such as a hydraulic control valve when the motor 117 is a hydraulic motor.

In this embodiment, the beams 122 of the guide 120 are linear members, and the support frame 110 supports the guide 120 for substantially linear movement with respect to the support frame 110, ignoring any deviation from a linear path caused by play between the beams 121 of the guide 120 and the rollers 115 and 116 which support the guide 120. However, it is also possible for the support frame 110 to support the guide 120 for nonlinear lateral movement with respect to the support frame 110, such as lateral movement along an arcuate path.

The carriage 130 of the manipulator 100 can have any structure which enables the carriage 130 to translate with respect to the guide 120 in the lengthwise direction of the guide 120 while supporting the clamping apparatus 30 or other load engaging attachment. In the present embodiment, the carriage 130 includes a body 131 which extends forwards from the guide 120 in a lengthwise direction of the forklift 10 by a sufficient distance that the clamping apparatus 30 can be transported laterally with respect to the forklift 10 without striking the support frame 110 or the forklift 10. Two plates 132 extend vertically upwards from the body 131 of the carriage 130, and a plurality of rollers 133 (two rollers 133 on each plate 132 in the illustrated embodiment) are rotatably mounted on the plates 132 for rotation about horizontal axes. Each of the rollers 133 rests on the lower flange of one of the beams 121 of the guide 120 so that the rollers 133 can roll along the lower flange while supporting the carriage 130, the clamping apparatus 30, and any load held by the clamping apparatus 30. Instead of being supported by rollers 133 for translation along the guide 120, the carriage 130 may be supported so that it slides along the guide 120. For example, the rollers 133 can be replaced by blocks which have a low-friction or lubricated surface and which slide along the beams 121.

In this embodiment, since the beams 121 of the guide 120 are straight members which translate along a linear path with respect to the support frame 110, the carriage 130 is supported by the guide 120 for lateral movement with respect to the support frame 110 along a linear path which is parallel to the path of movement of the guide 120. However, if the guide 120 has nonlinear portions, it is possible for the guide 120 to define a nonlinear path of lateral movement for the carriage 130 with respect to the support frame 110.

The clamping apparatus 30 in this embodiment includes a rigid frame 31 and a plurality of clamping arms 32 (four arms in this embodiment) pivotably mounted on the frame 31 for pivoting with respect to the frame 31 about horizontal axes. At its lower end, each clamping arm 32 is equipped with a plate-shaped contact portion 33 for contacting a side of a load and enabling the clamping apparatus 30 to grip the load. A plurality of actuators 34 in the form of hydraulic cylinders, for example, are mounted on the frame 31 and are connected to the clamping arms 32 so as to pivot the clamping arms 32 with respect to the frame 31 and bring the contact portions 33 into or out of contact with the sides of a load. Each actuator 34 has one end pivotably connected to a bracket 35 secured to the top of the frame 31 of the clamping apparatus 30 and a second end pivotably connected to one of the clamping arms 32. Hydraulic fluid for the actuators 34 can be supplied to the actuators 34 from the hydraulic system of the forklift 10 by unillustrated hydraulic lines. The actuators 34 can be controlled by the operator of the forklift 10 by a suitable controller, such as a conventional hydraulic control valve, provided on the forklift 10. The illustrated clamping apparatus 30 is similar to one described in detail in U.S. Pat. No. 8,142,131 entitled "Clamping Apparatus", the disclosure of which is incorporated by reference, so a further description of the structure and operation of the clamping apparatus 30 will be omitted. The clamping apparatus 30 is not restricted to use with a particular type of load, but it is particularly suitable for handling food and beverages, such as loads containing multiple cases of beer or soft drinks arranged in layers or loads containing packaged foods being shipped on pallets from manufacturers to wholesalers or retailers.

When the clamping apparatus 30 is positioned along the guide 120 in a location offset from the widthwise centerline 14 of the forklift 10, the forklift 10 may have a tendency to lean sideways with respect to the vertical due to the moment applied to the forklift 10 by the combined weight of the guide 120, the carriage 130, the clamping apparatus 30, and any load supported by the clamping apparatus 30. The sideways leaning of the forklift 10 can cause the guide 120 to slope downwards with respect to the horizontal away from the forklift 10. In order to maintain the clamping apparatus 30 level even when the forklift 10 is leaning to one side with respect to the vertical and the guide 120 is sloped with respect to the horizontal, the clamping apparatus 30 is preferably supported by the carriage 130 such that the clamping apparatus 30 can pivot with respect to the carriage 130. As best shown in FIG. 2, the clamping apparatus 30 includes two plates 36 which extend upwards from the frame 31 of the clamping apparatus 30. The plates 36 are pivotably connected to the carriage 130 by a shaft 135 which is supported by the carriage 130 and which enables the entire clamping apparatus 30 to pivot about the axis of the shaft 135 to maintain a level attitude. To limit the amount by which the clamping apparatus 30 can swing about the shaft 135 with respect to the carriage 130, the carriage 130 may be equipped with adjustment bolts 136 which threadingly engage brackets 137 on the sides of the carriage 130 and which have heads which oppose two of the mounting brackets 35 for the actuators 34 of the clamping apparatus 30. The bolts 136 can be advanced or retracted with respect to the brackets 137 of the carriage 130 to provide a sufficient separation between the bolts 136 and the mounting brackets 35 of the clamping apparatus 30 to allow the clamping apparatus 30 to pivot about the axis of the shaft 135 without uncontrolled swinging on the shaft 135.

The angle of tilt of the mast 12 with respect to the vertical as view from the side as seen in FIG. 2 can be adjusted so that the shaft 135 extends substantially parallel to the surface of which the forklift 10 is operating. Therefore, when the forklift 10 is operating on a horizontal surface, the angle of the mast 12 can be adjusted so that the shaft 135 extends substantially horizontally. Alternatively, a second shaft at right angles to shaft 135 can be provided to enable the clamping apparatus 30 to automatically pivot about two orthogonal axes so that the clamping apparatus 30 can remain level regardless of the angle of the mast 12 with respect to the vertical.

Figure 3:
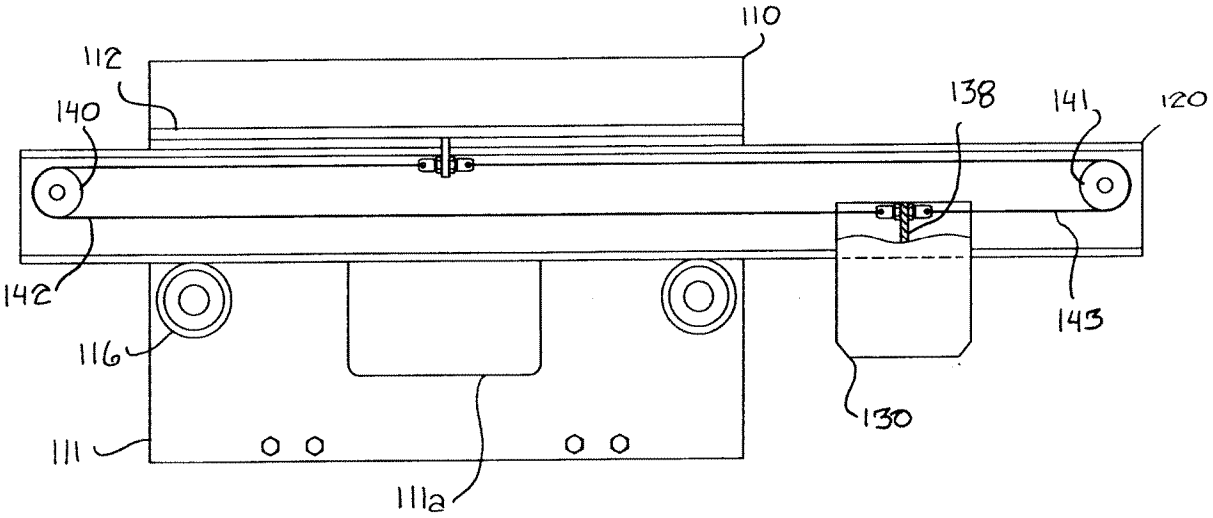
FIG. 3 is a schematic front elevation of a drive mechanism for translating a carriage of the manipulator along a movable guide.

The carriage 130 can translate with respect to the guide 120 in a lengthwise direction of the guide 120 to enable the clamping apparatus 30 to be moved laterally with respect to the support frame 110 and the forklift 10. Preferably the carriage 130 translates laterally with respect to the support frame 110 along the guide 120 at the same time and in the same general direction that the guide 120 translates laterally with respect to the support frame 110. A variety of mechanisms can be used to translate the carriage 130 along the guide 120. The present embodiment employs a chain and pulley arrangement which is schematically illustrated in FIG. 3. In this drawing, the support frame 110, the guide 120, and the carriage 130 are shown in simplified form, and a drive mechanism for translating the guide 120 with respect to the support frame 110 has been omitted. First and second chain pulleys 140 and 141 are rotatably supported by the guide 120 near each lengthwise end of the guide 120 for rotation about axes normal to the plane of the figure, and first and second chains 142 and 143 such as conventional roller chains or leaf chains pass around the first and second pulleys 140 and 141, respectively. Each chain 142 and 143 has one end secured to the support frame 110 at approximately the widthwise center of the support frame 110 or other convenient location and another end secured to the carriage 130. Alternatively, the two chains 142 and 143 can be combined to form a single chain which is connected to both the support frame 110 and the carriage 130. When the guide 120 is translated in its lengthwise direction with respect to the support frame 110, the carriage 130 is pulled by one of the chains 142 and 143 in the lengthwise direction of the guide 120 in the same direction that the guide 120 is translating. In the present embodiment, the lengths of the chains 142 and 143 are selected so that the carriage 130 is centered with respect to the widthwise centerline 14 of the forklift 10 in the widthwise direction of the forklift 10 when the guide 120 is also centered with respect to the widthwise centerline of the forklift 10. However, it is not necessary for the guide 120 or the carriage 130 to be capable of being centered with respect to the forklift 10.

Figure 4:
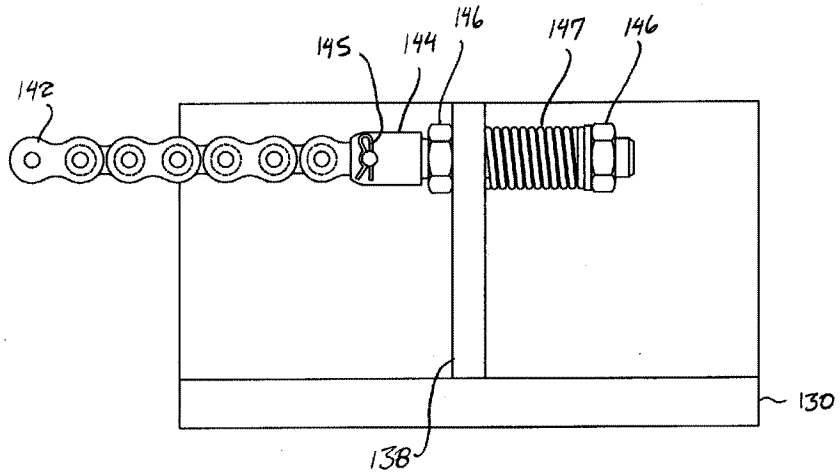
FIG. 4 is an enlarged front elevation of a mechanism for connecting a chain to the carriage in the drive mechanism shown in FIG. 3.

The manipulator 100 may include a tension adjusting mechanism to maintain a suitable tension in one or both chains 142 and 143. FIG. 4 illustrates an example of a tension adjusting mechanism for this purpose. The illustrated mechanism includes a conventional anchor bolt 144 for use with chains which is connected to one end of the first chain 142 by a cotter pin 145. The anchor bolt 144 passes loosely through a hole formed in a mounting plate 138 of the carriage 130 so that the anchor bolt 144 can slide in its axial direction with respect to the mounting plate 138. Two nuts 146 are mounted on the threaded end of the anchor bolt 144, and a compression spring 147 such as a die spring is disposed around the anchor bolt 144 between one of the nuts 146 and the mounting plate 138 of the carriage 130. The tension in the chain 142 can be adjusted to a desired level by tightening or loosening the nuts 146 to adjust the amount of compression of the spring 147. The tension adjusting mechanism prevents the first chain 142 from drooping as well as well as absorbs shocks applied to the chain 142 in its lengthwise direction which could damage the chain 142. A similar tension adjusting mechanism can instead be installed where the first chain 142 is connected to the support frame 110 or at both ends of the first chain 142. One or more similar tension adjusting mechanisms can also be provided for the second chain 143.

With the drive arrangement for the carriage 130 shown in FIG. 3, if the chains 142 and 143 are perfectly straight and perfectly parallel with each other, the speed at which the carriage 130 translates laterally with respect to the support frame 110 is twice the speed at which the guide 120 translates laterally with respect to the support frame 110. In actual practice, there is typically some sagging of the chains 142 and 143 over their lengths, and the chains may not be perfectly parallel with each other. Therefore, the actual ratio of the speed of translation of the carriage 130 with respect to the speed of translation of the guide 120 may deviate somewhat from 2:1. In addition, the speed ratio may vary over the range of travel of the carriage 130.

Figure 5:
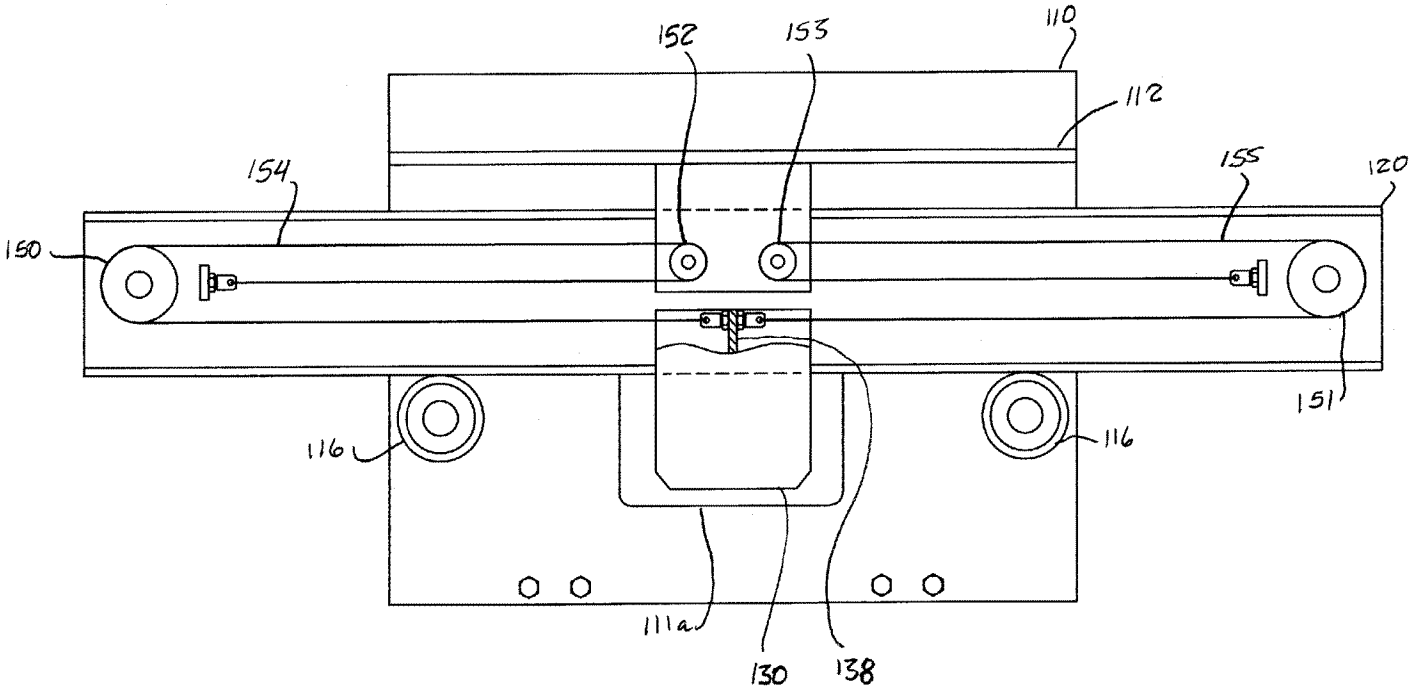
FIG. 5 is a schematic front elevation of another drive mechanism for translating the carriage of the manipulator along the movable guide.

A drive arrangement for translating the carriage 130 with respect to the guide 120 is not limited to one having the speed ratio of the drive arrangement shown in FIG. 3. FIG. 5 schematically illustrates a modification of the drive arrangement shown in FIG. 3 in which the ratio of the speed of lateral translation of the carriage 130 with respect to the support frame 110 to the speed of lateral translation of the guide 120 with respect to the support frame 110 is higher than with the arrangement shown in FIG. 3. As in FIG. 3, the support frame 110, the guide 120, and the carriage 130 in FIG. 5 are illustrated in simplified form, and a drive mechanism for translating the guide 120 with respect to the support frame 110 has been omitted. As shown in FIG. 5, first and second pulleys 150 and 151 are rotatably supported by the guide 120 at locations spaced from each other in the lengthwise direction of the guide 120. First and second chains 154 and 155 are secured to a mounting plate 138 of the carriage 130 and pass around the first and second pulleys 150 and 151, respectively. Third and fourth pulleys 152 and 153 are rotatably mounted on the support frame 110 at locations spaced from each other in the widthwise direction of the support frame 110. Instead of being secured to the support frame 110 as in FIG. 3, the first and second chains 154 and 155 pass around the third and fourth pulleys 152 and 153, respectively, and are secured at their ends to the guide 120 at locations spaced from each other in the lengthwise direction of the guide 120. In FIG. 5, the lengths of the chains 154 and 155 are selected so that the guide 120 and the carriage 130 are centered with respect to the support frame 110 and with respect to the widthwise centerline 14 of the forklift 10 at the same time.

If the chains 154 and 155 extend in perfectly straight lines parallel to each other between the pulleys, when the guide 120 translates to the left or right in FIG. 5 with respect to the support frame 110, the carriage 130 will translate with respect to the support frame 110 in the same direction as the guide 120 at three times the speed at which the guide 120 translates with respect to the support frame 110, although as is the case with the arrangement shown in FIG. 3, the exact speed ratio will typically deviate somewhat from a ratio of 3:1 due to sagging of the chains or due to the chains not being parallel to each other. In addition, the speed ratio may vary over the range of travel of the carriage 130 along the guide 120.

Figure 6:
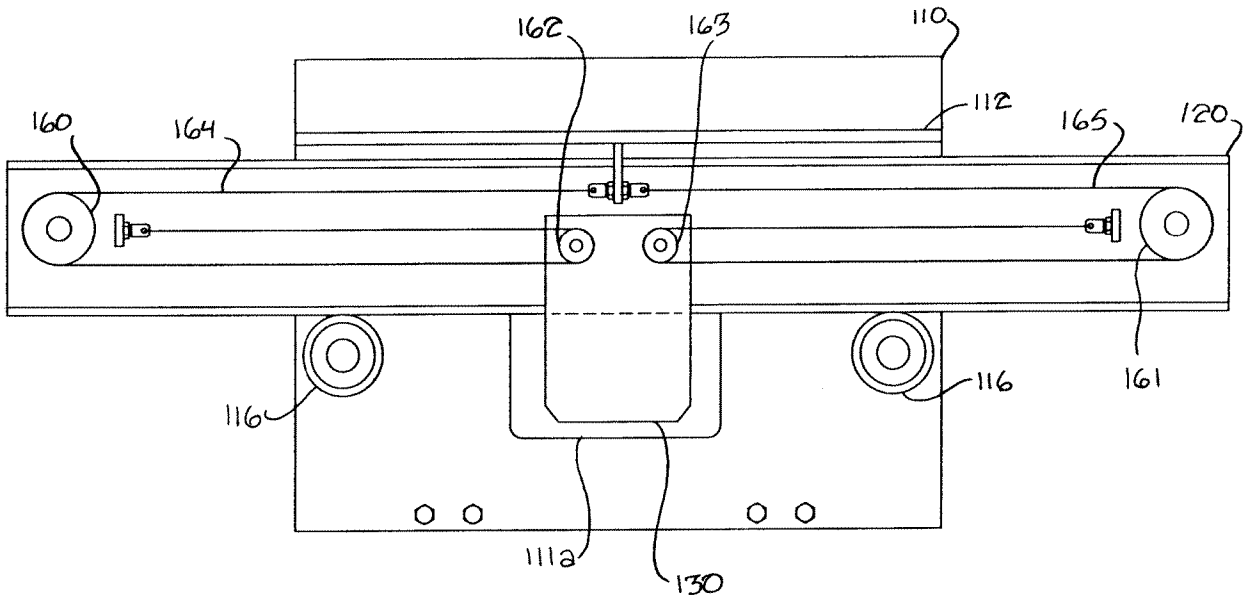
FIG. 6 is a schematic front elevation of yet another drive mechanism for translating the carriage of the manipulator along the movable guide.

FIG. 6 schematically illustrates another modification of the drive arrangement shown in FIG. 3 in which the ratio of the speed of lateral translation of the carriage 130 with respect to the support frame 110 to the speed of lateral translation of the guide 120 with respect to the support frame 110 is lower than with the arrangement shown in FIG. 3. In FIG. 6, the support frame 110, the guide 120, and the carriage 130 are shown in simplified form, and a drive mechanism for translating the guide 120 along the support frame 110 has been omitted. As shown in FIG. 6, first and second pulleys 160 and 161 are rotatably supported by the guide 120 at locations spaced from each other in the lengthwise direction of the guide 120. First and second chains 164 and 165 are secured to the support frame 110 and pass around the first and second pulleys 160 and 161, respectively. Third and fourth pulleys 162 and 163 are rotatably mounted on the carriage 130 at locations spaced from each other in the lengthwise direction of the guide 120. Instead of being secured to the carriage 130, the first and second chains 164 and 165 pass around the third and fourth pulleys 162 and 163, respectively, and are secured at their ends to the guide 120 at locations spaced from each other in the lengthwise direction of the guide 120. The lengths of the chains 164 and 165 in FIG. 6 are selected so that the guide 120 and the carriage 130 are centered with respect to the support frame 110 at the same time.

If the chains extend in perfectly straight, parallel lines between the pulleys, when the guide 120 translates to the left or right in FIG. 6 with respect to the support frame 110, the carriage 130 will translate with respect to the support frame 110 in the same direction as the guide 120 at 1.5 times the speed at which the guide 120 translates with respect to the support frame 110. In actual practice, the exact speed ratio will typically deviate somewhat from this value due to sagging of the chains or due to the chains not being parallel to one another. In addition, the speed ratio may vary over the range of travel of the carriage 130 along the guide 120.

In the drive mechanisms shown in FIGS. 3, 5, and 6, the chains act as flexible tension members which pull the carriage 130 in a lengthwise direction of the guide 120 as the guide 120 translates laterally with respect to the support frame 110. Other types of flexible tension members, such as belts or cables, can be used to pull the carriage 130 in a lengthwise direction of the guide 120, and members other than pulleys can be used to guide a flexible tension member as it pulls the carriage 130 along the guide 120, such as sprockets, rollers, or cylinders made of a low-friction material around which a flexible tension member can slide.

The distance by which the guide 120 and the carriage 130 can translate laterally with respect to a forklift or other vehicle on which the manipulator 100 is mounted can be selected based on the intended use of the manipulator 100. The manipulator 100 will frequently be used to transfer a load from the center of a first pallet to the center of a second pallet spaced from the first pallet in the widthwise direction of a forklift. In this situation, the carriage 130 of the manipulator 100 will typically translate laterally with respect to the forklift by the center-to-center distance between the two pallets.

Figure 7:
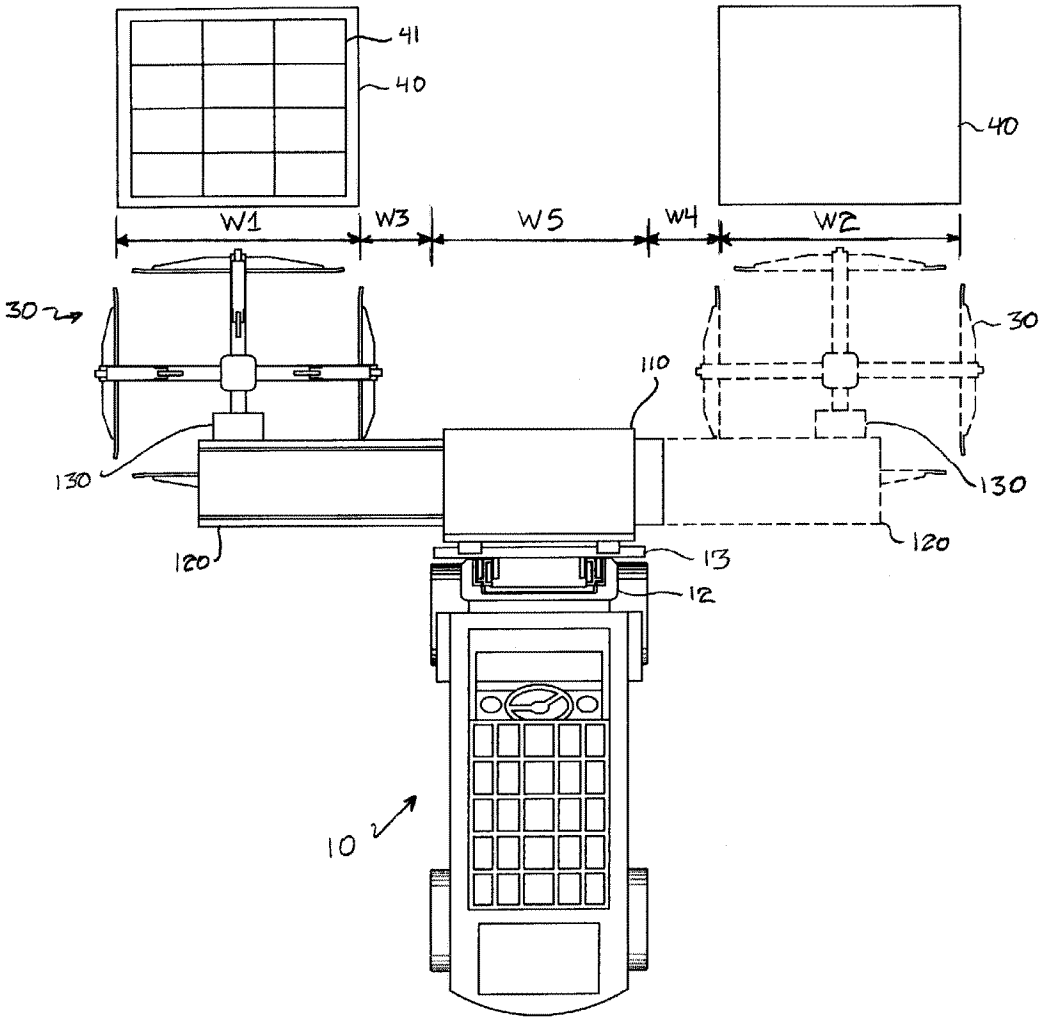
FIG. 7 is a schematic top view of the embodiment of FIG. 1 moving a load between two pallets disposed on opposite widthwise sides of a forklift.

FIG. 7 schematically illustrates an example of using the embodiment of a manipulator 100 shown in FIGS. 1 and 2 to transfer a load 41 from a first pallet 40 located on a first widthwise side of a forklift 10 (the lefthand side in FIG. 7) to a second pallet 40 disposed on a second widthwise side of the forklift 10 (the righthand side in FIG. 7), with no overlap between the forklift 10 and either pallet 40 in the widthwise direction of the forklift 10. The widths of the two pallets 40 in the widthwise direction of the forklift 10 are W1 and W2, respectively. The first pallet 40 is spaced from the first widthwise side of the forklift 10 by a distance W3, and the second pallet 40 is spaced from the second widthwise side of the forklift 10 by a distance W4. The forklift 10 has an overall width of W5. The load 41 is centered atop the first pallet 40 in the widthwise direction of the forklift 10, and the load 41 is to be placed atop the second pallet 40 so as to be centered on the second pallet 40 in the widthwise direction of the forklift 10. When the clamping apparatus 30 picks up the load 41, the clamping apparatus 30 and the carriage 130 of the manipulator 100 are centered with respect to the first pallet 40 in the widthwise direction of the forklift 10, and when the load 41 is placed atop the second pallet 40, the carriage 130 and the clamping apparatus 30 are centered with respect to the second pallet 40 in the widthwise direction of the forklift 10. Therefore, in order to transfer the load 41 from the first pallet 40 to the second pallet 40, the carriage 130 travels laterally by the center-to-center distance between the two pallets 40, which is equal to W1/2+W2/2+W3+W4+W5. In the United States, the most common pallet size is 48×40 inches. If W1 and W2 are each 48 inches, W3 and W4 are each 6 inches, and W5 is 48 inches (medium-size forklifts of approximately this width are often used in warehouses), then the distance traveled by the carriage 130 in transferring the load 41 between the pallets 40 is 108 inches.

Instead of being disposed on opposite widthwise sides of the forklift 10, if the same two pallets 40 as in FIG. 7 are disposed side by side with a separation of 6 inches between the two pallets, then the center-to-center distance between the two pallets is W1/2+6+W2/2=54 inches, so the carriage 130 will travel 54 inches in moving a load between the two pallets.

The range of lateral movement of the carriage 130 with respect to the forklift 10 depends on various factors such as the length of the guide 120, the distance by which the guide 120 can be extended laterally with respect to the support frame 110, and how close the carriage 130 can come to the lengthwise ends of the guide 120. The carriage 130 can be stopped at any point within this range of lateral movement by controlling the motor 117 for translating the guide 120.

An example of the operation of the embodiment shown in FIGS. 1 and 2 will be described with reference to FIG. 1, which shows the forklift 10 disposed between a row of pallets 40 each supporting a load 41 and a conventional roller conveyor 50 which can transport loaded pallets 40 within a warehouse. The forklift 10 is driven by the operator of the forklift 10 along the row of pallets 40 until the forklift 10 reaches a pallet 40 containing a load 41 at least a portion of which is to be moved to the roller conveyor 50 on the opposite widthwise side of the forklift 10. At this point, the forklift operator positions the clamping apparatus 30 with respect to the load 41 by controlling both the position of the forklift 10 in its lengthwise direction and the position of the clamping apparatus 30 laterally with respect to the forklift 10, and then the forklift operator lowers the clamping apparatus 30 by lowering the mast carriage 13 until the contact portions 33 of the clamping arms 32 of the clamping apparatus 30 are at a desired height with respect to the load 41, which in FIG. 1 comprises multiple layers of objects stacked atop the pallet 40. The clamping apparatus 30 is capable of lifting one or more layers of the load 41, but in this example, it will be assumed that the clamping apparatus 30 lifts the entire load 41 at one time. The forklift operator then operates the actuators 34 of the clamping apparatus 30 to press the contact portions 33 against the sides of the load 41 with sufficient force to support the weight of the load 41, with the force being determined by the weight and the nature of the load 41. The forklift operator then controls the forklift 10 to raise the clamping apparatus 30 and the load 41 by a sufficient distance for the load 41 to be clear of the pallet 40 or of any objects remaining on the pallet 40 if the clamping apparatus 30 lifts less than the entire load 41. The forklift operator then operates the motor 117 of the manipulator 100 to translate the guide 120 to the left in FIG. 1 and at the same time to translate the carriage 130, which supports the clamping apparatus 30 and the load 41, along the guide 120 to the left in FIG. 1. The motor 117 is operated by the forklift operator until the clamping apparatus 30 and the load 41 are positioned above the roller conveyor 50 on the left side of the forklift 10. The forklift operator then lowers the clamping apparatus 30 using the forklift 10 until the load 41 rests on the pallet 40 on the roller conveyor 50. The forklift operator then operates the actuators 34 of the clamping apparatus 30 to pivot the clamping arms 32 away from the sides of the load 41 to release the load 41, and then the forklift operator raises the clamping apparatus 30 above the load 41 until the clamping apparatus 30 is clear of the load 41. The forklift operator can then drive the forklift 10 to another location along the row of pallets 40 to access another load 41. The manipulator 100 can of course be used to transfer a load 41 in the opposite direction from the conveyor 50 to a pallet 40 located on the opposite widthwise side of the forklift 10.

During the above-described process of moving a load 41 between opposite widthwise sides of the forklift 10, it is unnecessary to rotate the clamping apparatus 30, the load 41, the mast 12 of the forklift 10, or any portion of the manipulator 100 about a vertical axis. As a result, wear and vibrations produced by a need to rotate components of the forklift 10 or the manipulator 100 about a vertical axis can be avoided, and the space around the forklift 10 necessary when moving a load between opposite widthwise sides of the forklift can be minimized.

Figure 8:
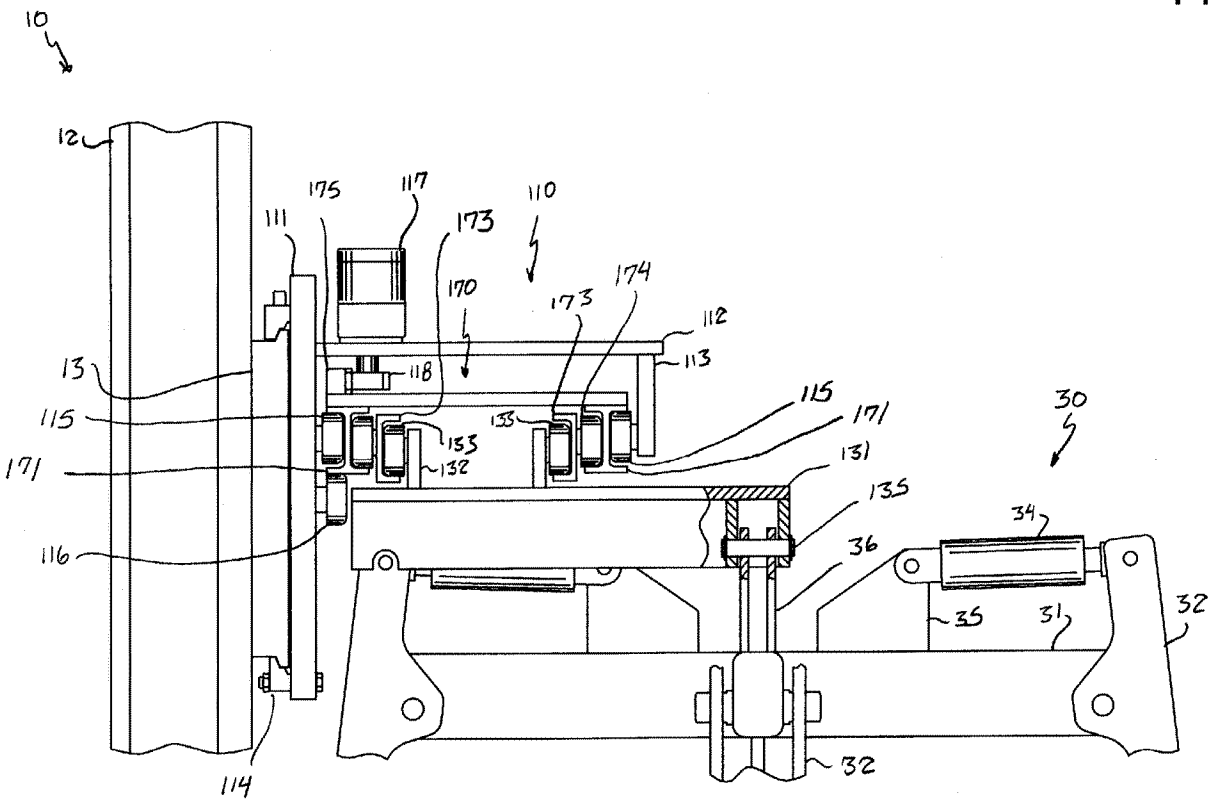
FIG. 8 is an enlarged side elevation of a portion of an embodiment of a manipulator according to the present invention having a movable guide with an adjustable length.

In the embodiment shown in FIGS. 1 and 2, the movable guide 120 has a fixed length. Alternatively, it is possible for the guide to have an adjustable length by forming it from a plurality of sections which can be extended or retracted with respect to each other in order to elongate or shorten the guide. FIG. 8 is a side elevation of a portion of an embodiment of a manipulator according to the present invention having an adjustable-length guide 170, and FIG. 9 is a schematic front elevation of a mechanism for adjusting the length of the guide 170.

The overall structure of this embodiment is similar to that of the embodiment of FIGS. 1 and 2, and components which are the same as or similar to components in FIGS. 1 and 2 are affixed with the same reference numbers as in FIGS. 1 and 2. As shown in FIG. 8, in this embodiment, the movable guide 170 includes a first section including two straight, rigid I-shaped beams 171 having the same structure as the beams 121 of the embodiment of FIGS. 1 and 2, and a second section including two straight, rigid channels 173 which are supported by the beams 171 for translation with respect to the beams 171 in the lengthwise direction of the beams 171. The beams 171 extend parallel to each other in a straight line extending in the widthwise direction of the forklift 10 and are rigidly connected with each other at a plurality of locations along their lengths by connecting plates 172 extending between the upper flanges of the beams 171. The channels 173 are disposed parallel to each other between the beams 171 and extend in a straight line parallel to the beams 171. A plurality of rollers 174 each having a horizontal rotational axis are rotatably mounted on each channel 173. Each roller 174 can roll along the lower flange of one of the beams 171 to enable the channels 173 to translate with respect to the beams 171 in the lengthwise direction of the guide 170. The rollers 133 of the carriage 130 are disposed inside the channels 173 so as to be able to roll along the lower flanges of the channels 173 in the lengthwise direction of the channels 173. In FIG. 8, the beams 171 and the channels 173 are shown extending normal to the plane of FIG. 8 and substantially parallel to a surface on which the forklift 10 is disposed. However, the beams 171 and channels 173 need not extend parallel to the surface of which the forklift 10 is disposed. For example, when the guide 170 is extended laterally from the support frame 110 and is supporting a heavy load, the load may cause the forklift 10 to lean to one side with respect to the vertical and cause the guide 170 to slope downwards from the support frame 110.

As in the embodiment shown in FIGS. 1 and 2, the beams 171 of the guide 170 are made to translate in the lengthwise direction of the guide 170 by a rack and pinion arrangement including a rack 175 secured atop the rear beam 171 of the guide 170 and a pinion 118 mounted on a motor 117 which is supported by the support frame 110. However, any of the drive mechanisms described with respect to the movable guide 120 of FIGS. 1 and 2 may instead be used to translate the beams 171.

Figure 9:
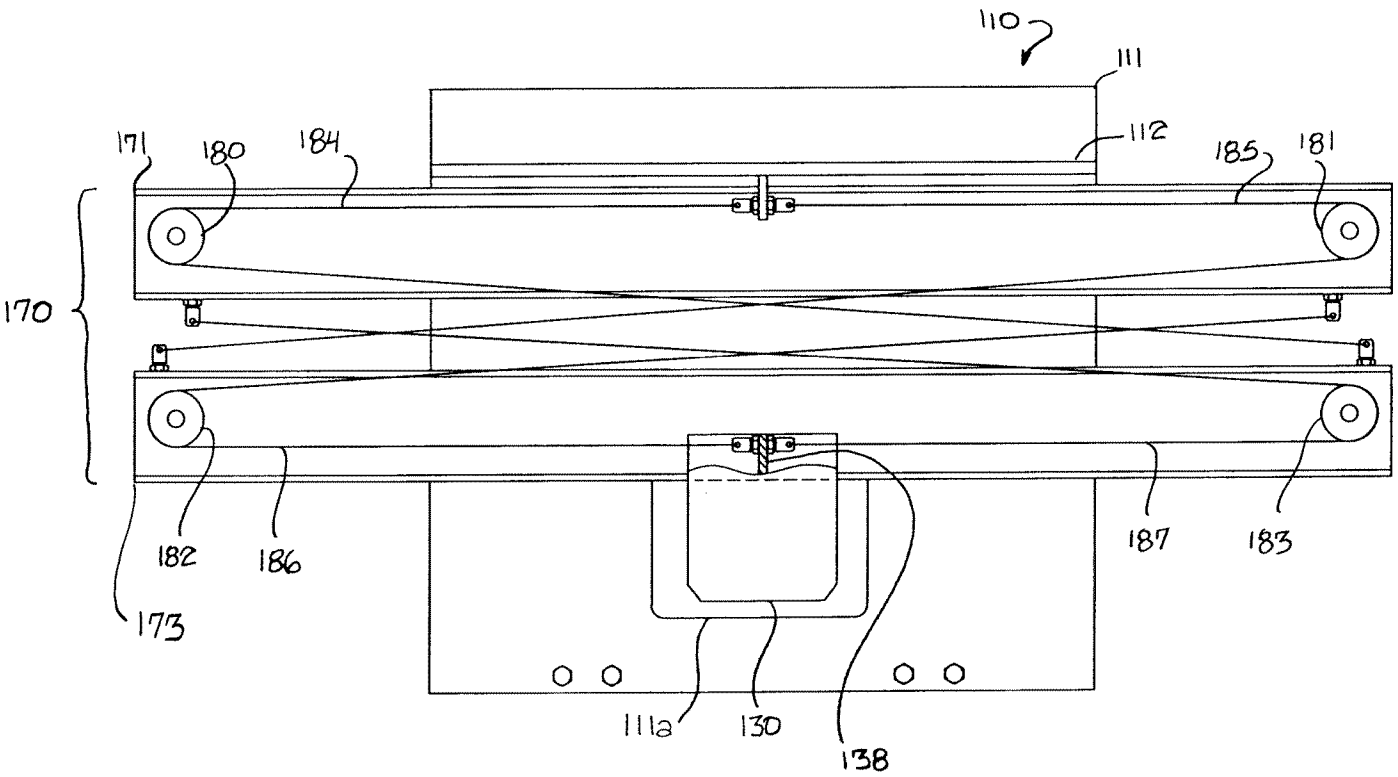
FIG. 9 is a schematic front elevation of a drive mechanism for translating the carriage of the manipulator of FIG. 8 along the guide of the manipulator while adjusting the length of the guide.

FIG. 9 schematically illustrates one example of a mechanism for adjusting the length of the guide 170 as it is translating laterally with respect to the support frame 110 and simultaneously translating the carriage 130 in the lengthwise direction of the guide 170 in the same direction as the guide 170 is translating. In FIG. 9, the support frame 110, the guide 170, and the carriage 130 are shown in simplified form, and the rack and pinion mechanism for translating the beams 171 of the guide 170 has been omitted. In addition, for ease of illustration, only one of the beams 171 and only one of the channels 173 of the guide 170 are shown.

First and second pulleys 180 and 181 with horizontal axes of rotation are rotatably supported by one or both of the beams 171 at locations spaced from each other in the lengthwise direction of the beams 171. Third and fourth pulleys 182 and 183 with horizontal axes of rotation are rotatably supported by one or both channels 173 at locations spaced from each other in the lengthwise direction of the channels 173. First and second chains 184 and 185 pass around the first and second pulleys 180 and 181, respectively, and third and fourth chains 186 and 187 pass around the third and fourth pulleys 182 and 183, respectively.

The first chain 184 has one end which is secured to the support frame 110 and another end which is secured to one of the channels 173, such as near the right end of the channel 173. The second chain 185 has one end which is secured to the support frame 110 and another end which is secured to one of the channels 173, such as near the left end of the channel 173.

The third chain 186 has one end which is secured to one of the beams 171, such as near the right end of the beam 171, and another end which is secured to the mounting plate 138 of the carriage 130. The fourth chain 187 has one end which is secured to one of the beams 171, such as near the left end of the beam 171, and another end which is secured to the mounting plate 138 of the carriage 130. In this figure, the lengths of the chains 184-187 are selected so that the carriage 130 is centered with respect to the channels 173 and the channels 173 are centered with respect to the beams 171 in the widthwise direction of the support frame 110 when the beams 171 are centered with respect to the support frame 110. Instead of there being four chains, the first and second chains 184 and 185 could be replaced by a single chain, and the third and fourth chains 186 and 187 could be replaced by a single chain.

When the motor 117 shown in FIG. 8 is operated by the forklift operator to translate the first section of the guide 170 (comprising the beams 171) with respect to the support frame 110 to the right or the left in FIG. 9, the first and second chains 184 and 185 pull the second section of the guide 170 (comprising the channels 173) to translate with respect to the beams 171 in the same direction and at the same time as the beams 171 are translating with respect to the support frame 110 along a path parallel to the path of movement of the beams 171. Furthermore, as the second section of the guide 170 comprising the channels 173 translates with respect to the beams 171, the third and fourth chains 186 and 187 pull the carriage 130 to translate in the same direction and at the same time as the channels 173 are translating parallel to the paths of movement of the beams 171 and the channels 173. In this manner, the beams 171, the channels 173, and the carriage 130 simultaneously translate in the same direction, with the channels 173 extending past the beams 171 in the direction of translation.

The overall length of the guide 170 in FIGS. 8 and 9 can be varied between a maximum length in which the beams 171 and the channels 173 are extended laterally with respect to the support frame 110 as far as possible, and a minimum length in which the beams 171 and the channels 173 are fully retracted with respect to the support frame 110. When it is desired to access a load disposed on a widthwise side of the forklift 10 using the clamping apparatus 30, the guide 170 can be extended by any amount up to its maximum length. When it is not necessary to access a load disposed on a widthwise side of the forklift 10, such as when the forklift 10 is traveling between different locations along a row of pallets, the guide 170 can be shortened to its minimum length. In the retracted state, the overall length of the guide 170 can be significantly less than in the fully extended state, so the overall width of the manipulator measured in the widthwise direction of the forklift 10 is reduced, making it easier for the forklift 10 to travel through narrow spaces, such as along narrow aisles between storage shelves or rows of pallets.

Although the adjustable-length guide 170 shown in FIGS. 8 and 9 has two sections which can be extended or retracted with respect to each other, it is possible to form an adjustable-length guide with a larger number of sections which can be extended or retracted to adjust the length of the guide. For example, an adjustable-length guide may include a first section which is supported by the support frame 110 for lateral translation with respect to the support frame 110, a second section which is supported by the first section for translation with respect to the first section in the lengthwise direction of the first section, and a third section which is supported by the second section for translation with respect to the second section in the lengthwise direction of the second section, with the carriage 130 being supported by the third section for translation with respect to the third section in the lengthwise direction of the third section.

Figure 10A:
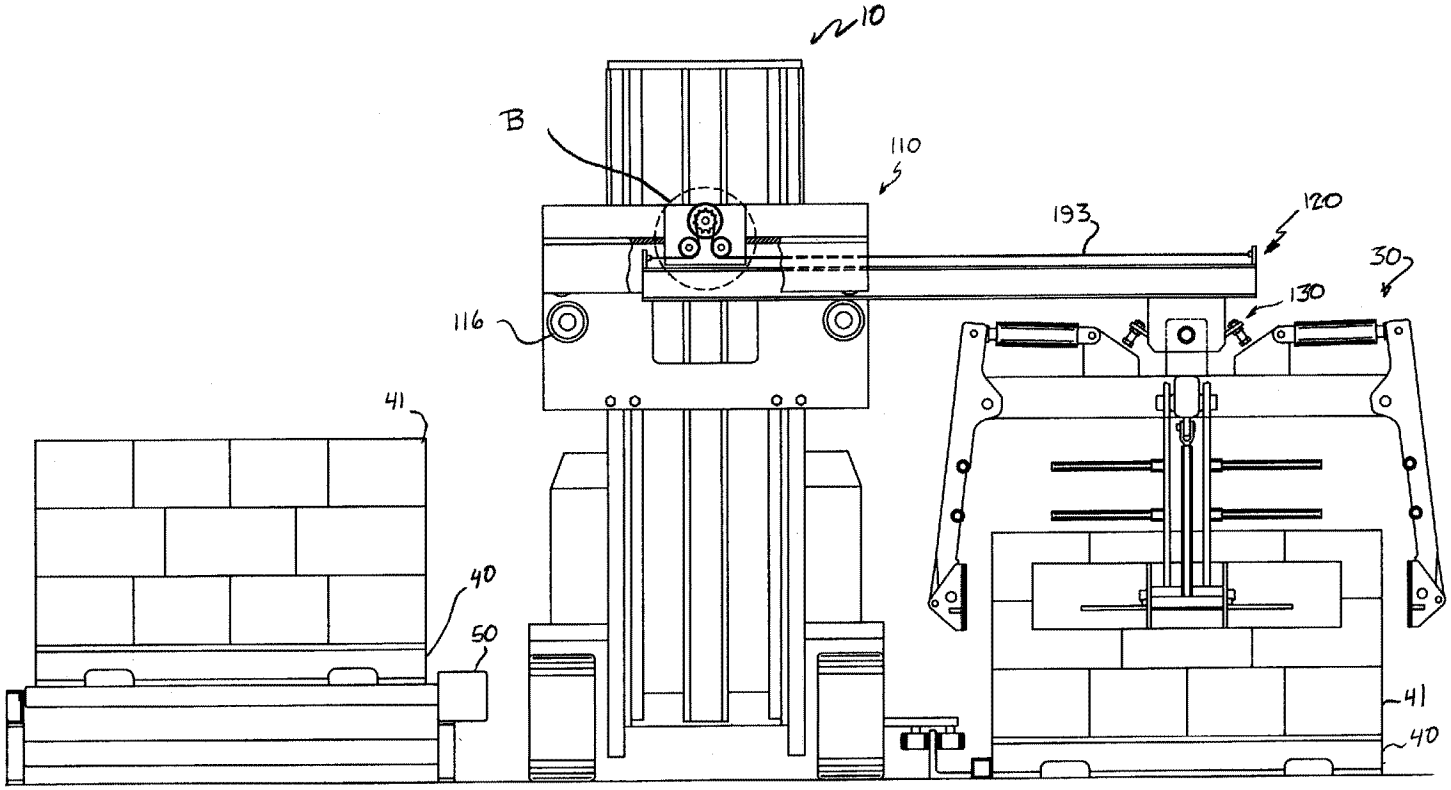
FIG. 10A is a front elevation of another embodiment of a manipulator according to the present invention mounted on a forklift.
Figure 10B:
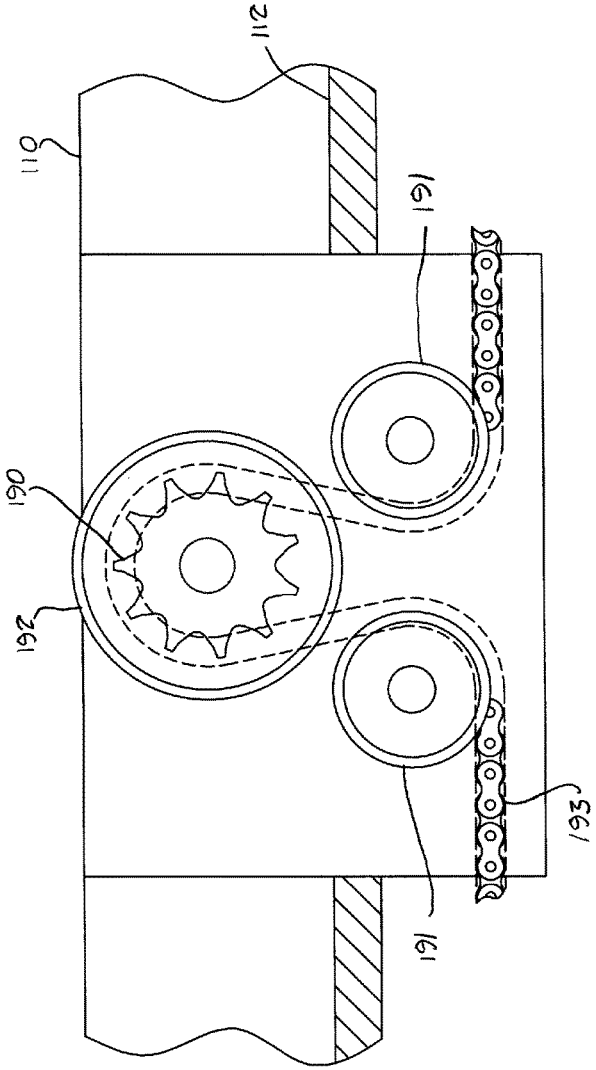
FIG. 10B is an enlarged view of region B in FIG. 10A.

As stated above, various types of drive mechanisms can be used to translate the movable guide 120 in its lengthwise direction with respect to the support frame 110. FIG. 10A is a schematic front elevation of an embodiment of a manipulator according to the present invention which employs a chain and sprocket arrangement as a drive mechanism for the guide 120, and FIG. 10B is an enlarged view of region B in FIG. 10A. The overall structure of this embodiment is similar to that of the embodiment shown in FIGS. 1 and 2, and components which are the same as or similar to components in FIGS. 1 and 2 are identified by the same reference numbers as in FIGS. 1 and 2. The guide 120 is shown as being a fixed-length guide like the guide 120 shown in FIGS. 1 and 2, but it may instead be an adjustable-length guide such as the guide 170 shown in FIGS. 8 and 9. The guide 120 is supported for translation with respect to the support frame 110 in the lengthwise direction of the guide 120 by multiple rollers in the same manner as in FIGS. 1 and 2. A drive sprocket 190 and two idle pulleys 191 are rotatably supported by the support frame 110 above the guide 120. The drive sprocket 190 can be rotated in the clockwise or counterclockwise direction in the figures by a motor 192, such as a hydraulic or electric motor, which is mounted on the support frame 110 coaxially with the drive sprocket 190. The motor 192 can be controlled by the forklift operator using a suitable controller mounted on the forklift 10. A roller chain 193 has first and second ends which are secured to opposite lengthwise ends of the guide 120. A tension adjusting mechanism, such as the mechanism shown in FIG. 4, may be connected to the chain 193 to maintain a suitable tension in the chain 193. As best shown in FIG. 10B, the chain 193 is wrapped partway around each of the idle pulleys 191 on the lower sides thereof and is wrapped over the upper portion of the drive sprocket 190 so that the teeth of the drive sprocket 190 drivingly engage the chain 193. When the motor 192 is driven to rotate the drive sprocket 190 in the clockwise direction in FIGS. 10A and 10B, the guide 120 is pulled by the chain 193 to translate in the lengthwise direction of the guide 120 to the right in FIG. 10A, and when the motor 192 is driven to rotate the drive sprocket 190 in the counterclockwise direction, the guide 120 is pulled by the chain 193 to translate in the lengthwise direction of the guide 120 to the left in FIG. 10A. As in the embodiment of FIGS. 1 and 2, when the guide 120 translates laterally with respect to the forklift 10, the carriage 130 translates at the same time and in the same direction as the guide 120 to transport the clamping apparatus 30 laterally with respect to the forklift 10. A drive mechanism for translating the carriage 130 with respect to the guide 120 may be similar to the arrangements shown in any of FIGS. 3, 5, and 6, for example.

As is the case with respect to the drive arrangements for the carriage 130 shown in FIGS. 3, 5, and 6, a drive arrangement for the guide 120 is not limited to one using a chain 193, and a different type of flexible tension member, such as a belt or a cable, can be used instead of a chain to pull the guide 120 to the left or right in FIG. 10A. In addition, a member other than a sprocket 193, such as a pulley or a roller, can be used to drive a flexible tension member.

Figure 11:
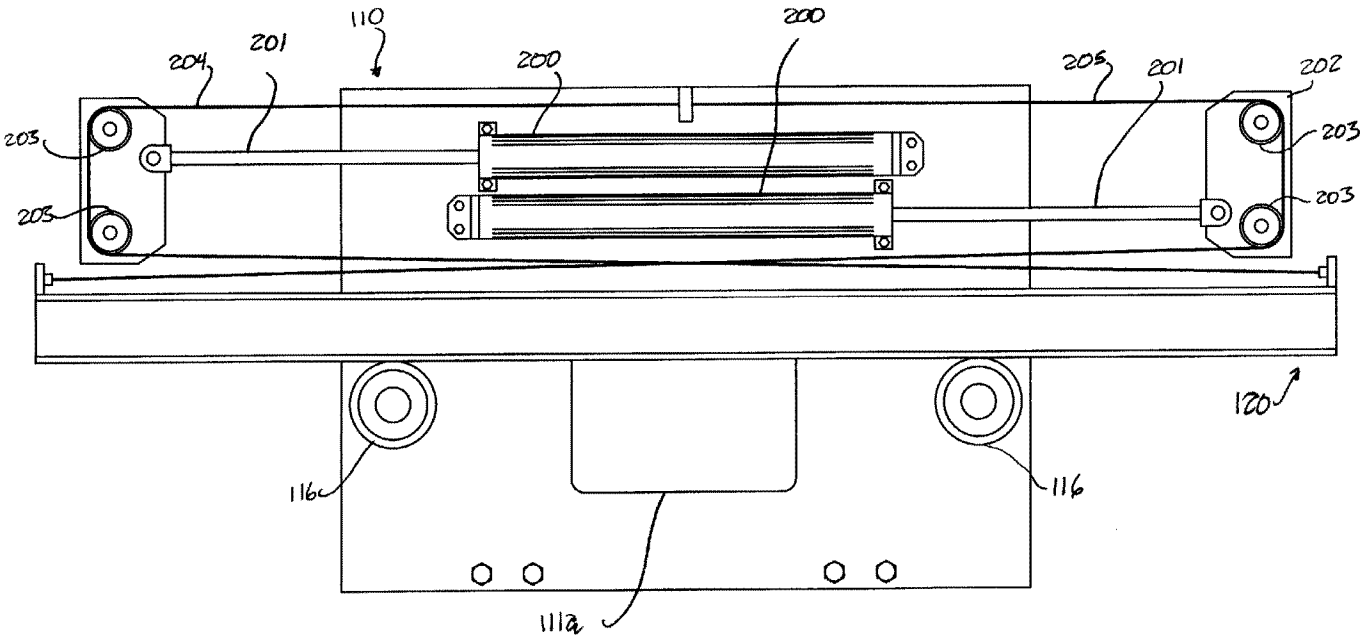
FIG. 11 is a schematic front elevation of a portion of an embodiment of a manipulator according to the present invention which uses hydraulic cylinders to translate a movable guide with respect to a support frame.

FIG. 11 is a schematic front elevation of a portion of another embodiment of a manipulator according to the present invention which employs a drive mechanism including hydraulic cylinders to translate a guide 120 in its lengthwise direction. In FIG. 11, the support frame 110 and the guide 120, which may have basically the same structure as in the embodiment of FIGS. 1 and 2, are shown in simplified form, and the carriage 130 and a drive mechanism for translating the carriage 130 with respect to the guide 120 have been omitted. The guide 120 in FIG. 11 is a fixed-length guide like the guide 120 shown in FIGS. 1 and 2, but it may instead be an adjustable-length guide, such as the guide 170 shown in FIGS. 8 and 9. Unillustrated portions of this embodiment may have the same structure as in any of the above-described embodiments.

Two hydraulic cylinders 200 are mounted on the support frame 110. For ease of illustration, the two hydraulic cylinders 200 are shown being disposed one atop the other, but they may instead be installed at the same height as each other. Each hydraulic cylinder 200 has a piston rod 201, and a support plate 202 on which two idle pulleys 203 are rotatably mounted is secured to each piston rod 201 for translation in the lengthwise direction of the piston rod 201, which is shown in FIG. 11 as being the horizontal direction. A first chain 204 has one end secured to the righthand end of the guide 120 and another end secured to the support frame 110. Between its first and second ends, the first chain 204 passes around the two pulleys 203 on the lefthand support plate 202. A second chain 205 has one end secured to the lefthand end of the guide 120 and another end secured to the support frame 110. Between its first and second ends, the second chain 205 passes around the two pulleys 203 on the righthand support plate 202. The two chains 204 and 205 are shown connected to the support frame 110 at the same location as each other, but they may be connected to the support frame 110 at different locations from each other. It is also possible for the two chains 204 and 205 to be replaced by a single chain which is secured to the support frame 110 at its midportion or other location along its length. An unillustrated tension adjusting mechanism, such as the mechanism shown in FIG. 4, may be connected to one or both chains 204 and 205 to maintain a desired tension. The two hydraulic cylinders 200 are operated simultaneously so that when the piston rod 201 of one of the hydraulic cylinders 200 is being extended, the piston rod 201 of the other hydraulic cylinder 200 is being retracted.

When the piston rod 201 of the upper hydraulic cylinder 200 in FIG. 11 is being extended and the piston rod 201 of the lower hydraulic cylinder 200 is simultaneously being retracted, both support plates 202 simultaneously move to the left in the figure, and the guide 120 is pulled by the first chain 204 to the left in the lengthwise direction of the guide 120. When the piston rod 201 of the upper hydraulic cylinder 200 in FIG. 11 is being retracted and the piston rod 201 of the lower hydraulic cylinder 201 is simultaneously being extended, the two support plates 202 simultaneously move to the right in the figure, and the guide 120 is pulled in its lengthwise direction to the right by the second chain 205. On account of the pulleys 203, the guide 120 translates with respect to the support frame 110 farther and faster than do the support plates 202. For example, in this example, the guide 120 translates in its lengthwise direction with respect to the support frame 110 at approximately twice the speed and by approximately twice the distance as the support plates 202. However, the ratio of the speed of translation of the guide 120 to the speed of translation of the support plates 202 can be modified by the provision of additional pulleys around which the chains 204 and 205 pass in a manner similar to that shown in FIGS. 5 and 6, for example.

The two hydraulic cylinders 200 shown in FIG. 11 can be replaced by a single hydraulic cylinder having two piston rods connected to a single piston, with each piston rod extending from an opposite lengthwise end of the hydraulic cylinder. A support plate 202 with pulleys 203 can be mounted on the outer end of each piston rod. With such an arrangement, one hydraulic cylinder can perform the same function as the two hydraulic cylinders 200 in FIG. 11.

Figure 12:
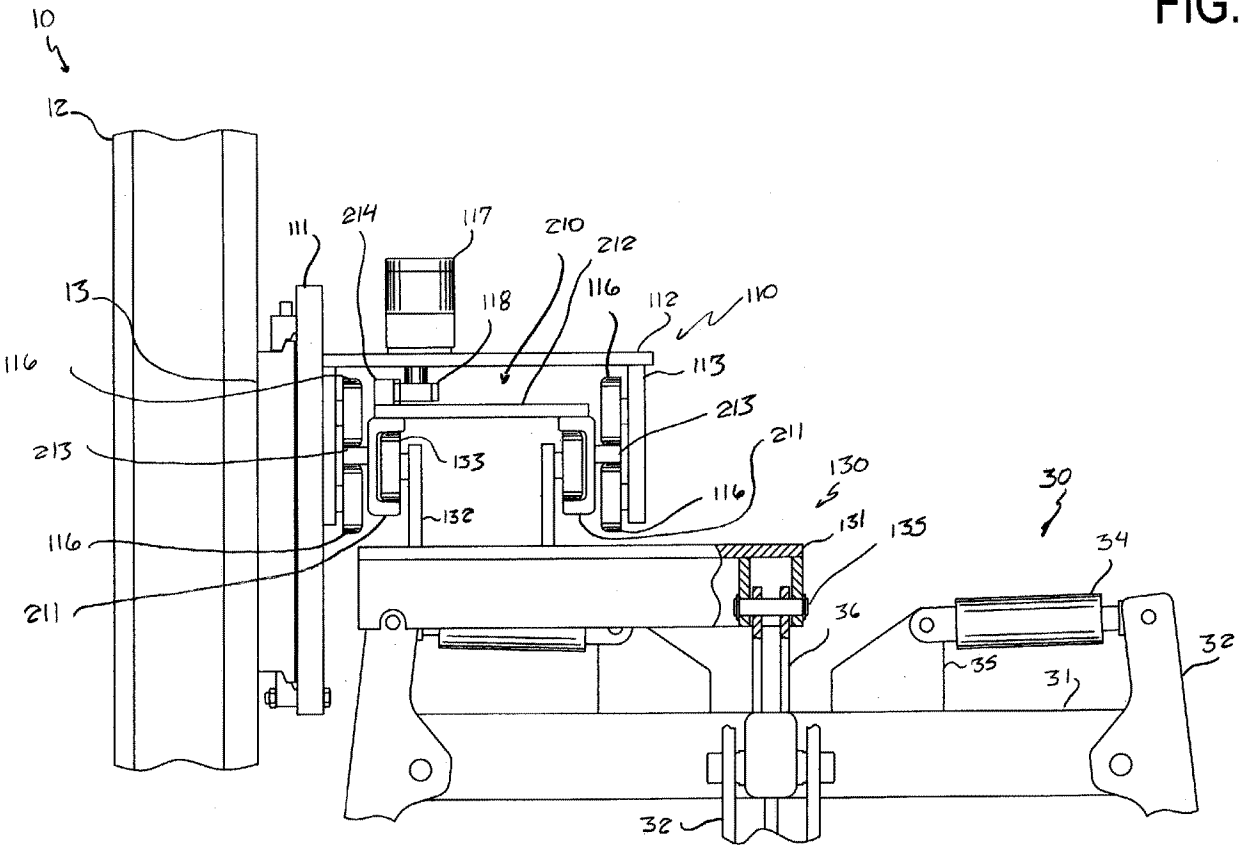
FIG. 12 is a side elevation of a portion of another embodiment of the present invention.

FIG. 12 is a side elevation of a portion of another embodiment of the present invention. The overall structure of this embodiment is similar to that of the embodiment of FIGS. 1 and 2, and components of this embodiment which are the same as or similar to components of the embodiment of FIGS. 1 and 2 are affixed with the same reference numbers as in FIGS. 1 and 2. This embodiment differs from the embodiment of FIGS. 1 and 2 with respect to the structure of a movable guide 210. In contrast to the movable guide 120 shown in FIGS. 1 and 2 which comprises I-shaped beams 121, the movable guide 210 illustrated in FIG. 12 comprises two straight rigid channels 211 which extend parallel to each other in the widthwise direction of a forklift 10, the mast 12 of which is shown on the lefthand side of the drawing. The channels 211 are rigidly secured to each other at a plurality of locations along the length of the channels 211 by connecting plates 212. A rack 214 corresponding to the rack 123 in the embodiment of FIGS. 1 and 2 is supported atop the rear of the two channels 211 and extends parallel to the channels 211 in the widthwise direction of the forklift 10. The channels 211 extend normal to the plane of the figure and parallel to the surface on which the forklift 10 is disposed. When the mast 12 of the forklift 10 extends vertically, the channels 211 extend horizontally, although it is also possible for the channels 211 to be sloped with respect to the horizontal. A straight rigid plate 213 which extends over the length of each channel 211 parallel to the channel 211 is secured to the back surface of each channel 211. Upper and lower rollers 116 are rotatably mounted on the first vertical portion 111 and the second vertical portion 113 of the support frame 110 at a plurality of locations spaced from each other in the widthwise direction of the forklift, and the plates 213 are supported from above and below by the rollers 116. In the present embodiment, each plate 213 is supported from below by three rollers 116 and from above by three more rollers 116, but the number of rollers 116 can be selected based on the dimensions of the channels 211 and the weight which is to be supported by the rollers 116. The rollers 116 are able to stably support the plates 213 and the channels 211 with a minimum of play to reduce the tendency of the lengthwise ends of the guide 210 to slope downwards between the support frame 110 and a lengthwise end of the guide 210 when the guide 210 is extended laterally from the support frame 110 and is supporting a heavy weight.

The carriage 130 is equipped with rollers 133 which are received between the upper and lower flanges of the channels 211 and are supported by the channels 211 in a manner similar to the way the rollers 133 are supported by the I-shaped beams 121 in the embodiment of FIGS. 1 and 2 so that the carriage 130 can translate in the lengthwise direction of the guide 210 while being supported by the channels 211. The guide 210 can be made to translate laterally with respect to the support frame 110 by a rack and pinion mechanism similar to the one shown in FIGS. 1 and 2 and including a motor 117 and a pinion 118 which are supported by the support frame 110 and the above-mentioned rack 214 of the guide 210 which meshes with the pinion 118. Alternatively, any of the other above-described drive mechanisms for the movable guide may be used, such as the drive mechanisms described with respect to FIGS. 10A, 10B, and 11. The illustrated guide 210 has a fixed length, but it can be modified in a manner similar to that shown in FIG. 8 to convert it into an adjustable-length guide by providing two additional channels corresponding to the channels 173 in FIG. 8 between the channels 211 and the carriage rollers 133 in FIG. 12. The carriage 130 can be made to translate with respect to the guide 210 along the length of the guide 210 by any of the drive mechanisms described above. This embodiment can be operated in essentially the same manner as the embodiment of FIGS. 1 and 2.

Figure 13A:
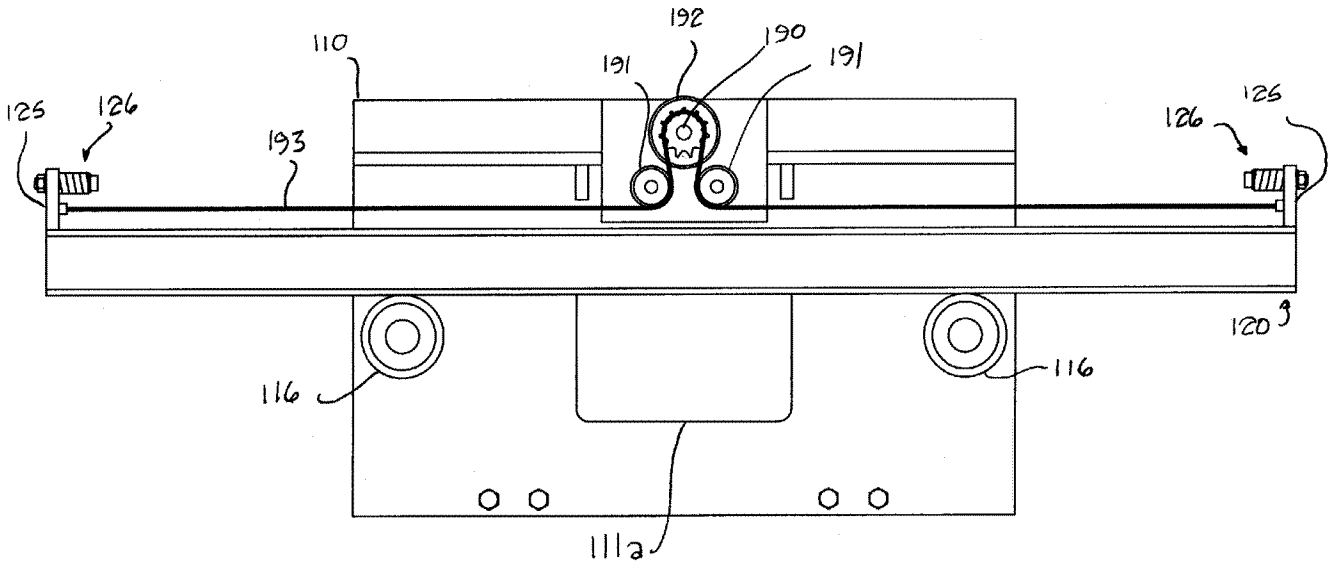
FIG. 13A is a schematic front elevation of a portion of an embodiment of a manipulator according to the present invention which is equipped with shock absorbers for the movable guide.
Figure 13B:
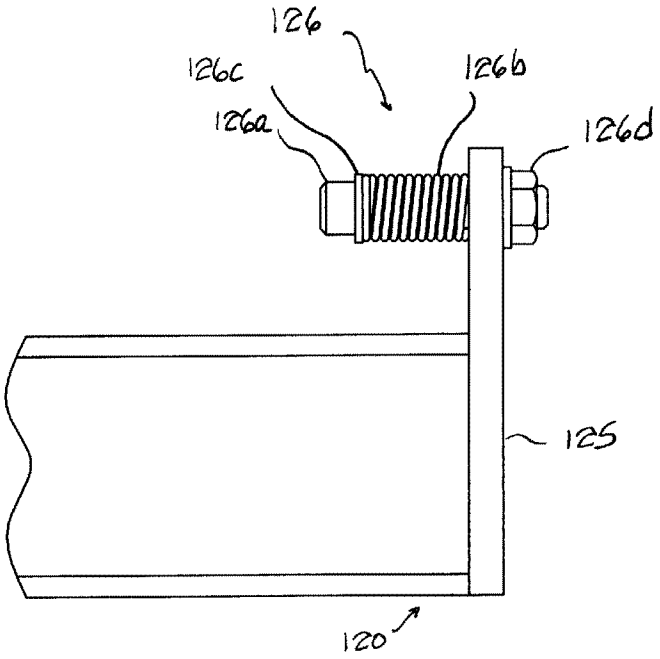
FIG. 13B is an enlarged view of one of the shock absorbers shown in FIG. 13A.

FIG. 13A is a schematic front elevation of a portion of another embodiment of the present invention in which the movable guide is equipped with shock absorbers 126 to reduce impacts between the guide 120 and the support frame 130, and FIG. 13B is an enlarged view of the shock absorber 126 at the righthand end of the guide 120 in FIG. 13A. The shock absorber 126 at the lefthand end of the guide 120 faces in the opposite direction from the shock absorber 126 shown in FIG. 13B but may otherwise have the same structure as the shock absorber 126 in FIG. 13B. The overall structure of this embodiment is similar to that of the embodiment shown in FIG. 10A, and components which are the same as or similar to components in FIG. 10A are identified by the same reference numbers as in FIG. 10A. In FIG. 13A, the support frame 110 and the guide 120 are shown in simplified form, and the carriage 130 as well as a mechanism for translating the carriage with respect to the guide 120 have been omitted. The guide 120 is equipped with a drive mechanism having the same structure as shown in FIGS. 10A and 10B, but any of the other previously-described drive mechanisms for translating the guide 120 with respect to the support frame 110 can instead be employed. The guide 120 is shown as being a fixed-length guide like the guide 120 shown in FIG. 10A, but it may instead be an adjustable-length guide such as the guide 170 shown in FIGS. 8 and 9.

Two stopping members such as rigid plates 119 are secured to the support frame 110 above the guide 120 and along the path of movement of the guide 120 to limit the amount by which the guide 120 can translate in its lengthwise direction. A support plate 125 is secured to each lengthwise end of the guide 120, and one of the shock absorbers 126 is mounted on each support plate 125 at a height such that the shock absorbers 126 will contact one of the stopping plates 119 when the guide 120 translates by a sufficient distance to the right or the left in FIG. 13A. FIG. 13A shows only one shock absorber 126 disposed at each lengthwise end of the guide 120, but a plurality of shock absorbers 126 arranged in parallel may be provided at one or both ends of the guide 120.

Each shock absorber 126 comprises a shoulder bolt 126*a* which passes loosely through a hole formed in the support plate 125 and which is slidably supported by the support plate 125 so that the bolt 126*a* can translate in its axial direction with respect to the support plate 125. Each bolt 126*a* has a head (a socket head in the illustrated example) which faces towards the widthwise center of the support frame 110 and towards one of the stopping plates 119. A compression spring 126*b* (such as a coil spring) and a washer 126*c* are mounted on the bolt 126*a* between the head of the bolt 126*a* and the support plate 125. The bolt 126*a* is retained on the support plate 125 by a hex nut 126*d* which is screwed onto the threads of the bolt 126*a* on the opposite side of the support plate 125 from the spring 126*b*. The washer 126*c* abuts against the shoulder defined by the head of the bolt 126*a* and prevents the spring 126*b* from becoming detached from the bolt 126*a*. In the state shown in FIG. 13B, the spring 126*b* may be in an uncompressed state, or it may slightly compressed in order to exert a biasing force on the head of the bolt 126*a* in the direction away from the support plate 125.

When the guide 120 is being translated with respect to the support frame 110 to the right or left in FIG. 13A and the head of the bolt 126*a* of either shock absorber 126 collides with one of the stopping plates 119 of the support frame 110, the impact causes the bolt 126*a* to slide in its axial direction with respect to the support plate 125 on which the bolt 126*a* is mounted against the biasing force of the spring 126*b*, and the compression of the spring 126*b* caused by the sliding movement of the bolt 126*a* produces a shock absorbing action which brings the guide 120 to a gradual and gentle stop. When the forklift operator sees that the guide 120 has stopped translating laterally with respect to the support frame 110, the forklift operator can turn off the drive motor 192 for the sprocket 190, and the guide 120 will remain in the stopped position. The shock absorbers 126 not only prevent the manipulator from being damaged by strong impacts between the guide 120 and the stopping plates 119 of the support frame 110 but also protect the clamping apparatus and a load supported by the clamping apparatus against damaging shocks.

As an alternative to the arrangement shown in FIGS. 13A and 13B, stopping members such as the stopping plates 119 can be mounted on the ends of the guide 120 instead of on the support frame 110, and shock absorbers such as the shock absorbers 126 shown in FIGS. 13A and 13B can be mounted on the support frame 110 in the path of movement of the stopping members on the guide 120. Thus, shock absorbers can be mounted on any locations where they can reduce the force of impacts between the support frame 110 and the guide 120.

What is claimed is:

1. A manipulator for moving a load laterally with respect to a vehicle comprising:

a support frame adapted for mounting on the vehicle so as to be raised and lowered with respect to the vehicle;

a movable guide having first and second lengthwise ends, a front side which faces away from the vehicle when the support frame is mounted on the vehicle and a rear side which faces towards the vehicle when the support frame is mounted on the vehicle, the guide being supported by the support frame for lateral translation with respect to the support frame from the front side of the guide by a plurality of first rollers mounted on the support frame and from the rear side of the guide by a plurality of second rollers mounted on the support frame, the guide comprising first and second elongated rigid guide members rigidly secured to each other and extending parallel to each other at the same height as each other when the support frame is mounted on the vehicle, a space which extends in a lengthwise direction of the guide being formed between the first and second guide members, the first guide member sitting directly on the first rollers and the second guide member sitting directly on the second rollers; and a carriage for supporting a load engaging attachment capable of supporting a load, the carriage being supported by the guide for translation with respect to the guide in the lengthwise direction of the guide as the guide is translating with respect to the support frame, the carriage including a portion which is disposed in the space between the two guide members, the carriage being supported from opposite sides of the space by the first and second guide members through a plurality of rollers mounted on the portion of the carriage disposed in the space.

2. A manipulator as claimed in claim 1 including a flexible tension member which extends between the guide and the carriage and pulls the carriage in the lengthwise direction of the guide as the guide is translating with respect to the support frame.

3. A manipulator as claimed in claim 2 wherein the flexible tension member is selected from a chain, a belt, and a cable.

4. A manipulator as claimed in claim 2 wherein the flexible tension member passes around a rotating member selected from a sprocket and a pulley which is rotatably supported by the guide.

5. A manipulator as claimed in claim 2 further comprising an in-line tension adjusting member connected to an end of the tension member and comprising an elongated threaded connector connected in-line to the end of the tension member and slidably supported by one of the support frame and the carriage, a biasing spring which is mounted on the connector and biases the connector in a direction applying tension to the tension member, and a nut threadingly engaging the connector and rotatable with respect to the connector to adjust the biasing force exerted by the spring.

6. A manipulator as claimed in claim 5 wherein the tension member comprises a chain, and the connector comprises an anchor bolt connected to an end of the chain.

7. A manipulator as claimed in claim 1 wherein the guide has a constant length.

8. A manipulator as claimed in claim 1 wherein the guide has an adjustable length.

9. A manipulator as claimed in claim 6 wherein the guide comprises a plurality of sections which can be extended and retracted with respect to each other in the lengthwise direction of the guide to adjust the length of the guide.

10. A manipulator as claimed in claim 8 wherein the length of the guide varies as the guide translates laterally with respect to the support frame.

11. A manipulator as claimed in claim 1 wherein the carriage can translate in opposite directions with respect to the support frame by equal distances from a widthwise center of the support frame.

12. A load handling arrangement comprising:

a vehicle having a lifting mechanism capable of raising and lowering a load;

a manipulator as claimed in claim 1 supported by the lifting mechanism so as to be raised and lowered by the lifting mechanism; and a load engaging attachment supported by the carriage of the manipulator for supporting a load.

13. A load handling arrangement as claimed in claim 12 wherein the vehicle comprises a forklift having a mast, and the manipulator is supported by the mast of the forklift.

14. A load handling arrangement as claimed in claim 12 wherein the manipulator can translate a load in the lengthwise direction of the guide between opposite widthwise sides of the vehicle without rotating the load about a vertical axis.

15. A method of moving a load comprising:

engaging a load disposed at a first location with the load engaging attachment of the load handling arrangement of claim 12;

raising the load engaged by the load engaging attachment using the lifting mechanism of the vehicle;

simultaneously translating the guide and the carriage of the manipulator laterally with respect to the vehicle to move the load to a second location laterally spaced from the first location; and lowering the load using the lifting mechanism and disengaging the load engaging attachment from the load to deposit the load at the second location.

16. A method as claimed in claim 15 wherein the load is spaced from a widthwise side of the vehicle without any overlap with the vehicle in a widthwise direction of the vehicle when disposed at one or both of the first and second locations.

17. A method as claimed in claim 15 including lifting the load from atop a first pallet at the first location and placing the load atop a second pallet at the second location.

18. A method as claimed in claim 15 including moving the load by greater than a width of the vehicle when moving the load between the first and second locations.

19. A method as claimed in claim 15 including moving the load between the first and second locations without rotating the load about a vertical axis.

20. A method as claimed in claim 15 including changing a length of the guide as the guide and the carriage translate laterally with respect to the vehicle.

21. A method as claimed in claim 15 including translating the guide and the carriage along parallel linear paths.

22. A load handling arrangement as claimed in claim 12 wherein the load engaging attachment is pivotably supported by the carriage of the manipulator for pivoting about a horizontal axis extending in a lengthwise direction of the vehicle to enable the load engaging attachment to remain level even when the guide is sloped with respect to a horizontal plane, and the carriage includes a stopper for limiting an angle of pivoting of the load engaging attachment with respect to the carriage by contacting the load engaging attachment.

23. A manipulator as claimed in claim 1 wherein:

each of the guide members includes a vertical web, the web having an upper end, a lower end, an inner side facing the other guide member, and an outer side facing away from the other guide member, each of the guide members further including an upper horizontal flange disposed at the upper end of the web and a lower horizontal flange disposed at the lower end of the web; and the plurality of rollers mounted on the portion of the carriage disposed in the space between the guide members include at least one roller disposed between the upper and lower flanges of the first guide member on the inner side of the web of the first guide member and resting on the lower flange of the first guide member, and at least one roller disposed between the upper and lower flanges of the second guide member on the inner side of the web of the second guide member and resting on the lower flange of the second guide member.

24. A manipulator as claimed in claim 23 wherein:

each of the guide members includes a horizontal plate secured to the outer side of the web of the guide member and extending in a lengthwise direction of the guide member, the plate of the first guide member resting directly on the first rollers and the plate of the second guide member resting directly on the second rollers; and the manipulator includes at least one roller mounted on the support frame above the plate of the first guide member for restraining the first guide member from above as the guide translates laterally with respect to the support frame and at least one roller mounted on the support frame above the plate of the second guide member for restraining the second guide member from above as the guide translates laterally with respect to the support frame.

25. A manipulator as claimed in claim 1 further comprising a shock absorber for decelerating the guide as it translates with respect to the support frame, the shock absorber comprising an elongated member slidably supported by the guide and a compression spring mounted on the elongated member, the support frame including a portion which is disposed in a path of movement of the elongated member.

* * * * *